US011248406B2

(12) United States Patent
Nordieker et al.

(10) Patent No.: US 11,248,406 B2
(45) Date of Patent: Feb. 15, 2022

(54) FLAP FITTING FOR A PIECE OF FURNITURE, SIDE WALL OF A BODY OF A PIECE OF FURNITURE AND PIECE OF FURNITURE COMPRISING A SIDE WALL

(71) Applicant: HETTICH-ONI GMBH & CO. KG, Vlotho (DE)

(72) Inventors: Martin Nordieker, Hüllhorst (DE); Jens Poischbeg, Leopoldshöhe (DE); Karsten Nolte, Lemgo (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 0 days.

(21) Appl. No.: 16/762,804

(22) PCT Filed: Nov. 6, 2018

(86) PCT No.: PCT/EP2018/080315
§ 371 (c)(1),
(2) Date: May 8, 2020

(87) PCT Pub. No.: WO2019/091968
PCT Pub. Date: May 16, 2019

(65) Prior Publication Data

US 2020/0362612 A1 Nov. 19, 2020

(30) Foreign Application Priority Data

Nov. 10, 2017 (DE) ..... 10 2017 126 369.1

(51) Int. Cl.
*E05F 1/08* (2006.01)
*E05F 5/06* (2006.01)
(Continued)

(52) U.S. Cl.
CPC ..... *E05F 5/02* (2013.01); *E05D 3/16* (2013.01); *E05D 15/40* (2013.01); *E05F 1/1058* (2013.01);
(Continued)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 3,760,455 A * 9/1973 Berry ..... E05F 3/226 16/53
7,478,891 B2 * 1/2009 Hollenstein ..... E05F 1/1058 312/319.2
(Continued)

FOREIGN PATENT DOCUMENTS

CN 204826984 U 12/2015
DE 102006007702 A1 8/2007
(Continued)

OTHER PUBLICATIONS

International Search Report dated Jan. 23, 2019 in related/corresponding International Application No. PCT/EP2018/080315.
(Continued)

*Primary Examiner* — Chuck Y Mah
(74) *Attorney, Agent, or Firm* — Patent Portfolio Builders PLLC

(57) ABSTRACT

A flap fitting for a piece of furniture includes a compound lever with a number of levers for guiding a wing of the piece of furniture, and a damping unit including at least one damper for damping the wing as it approaches a closed end position. The damping unit is arranged inside a housing of
(Continued)

Figure 1A:
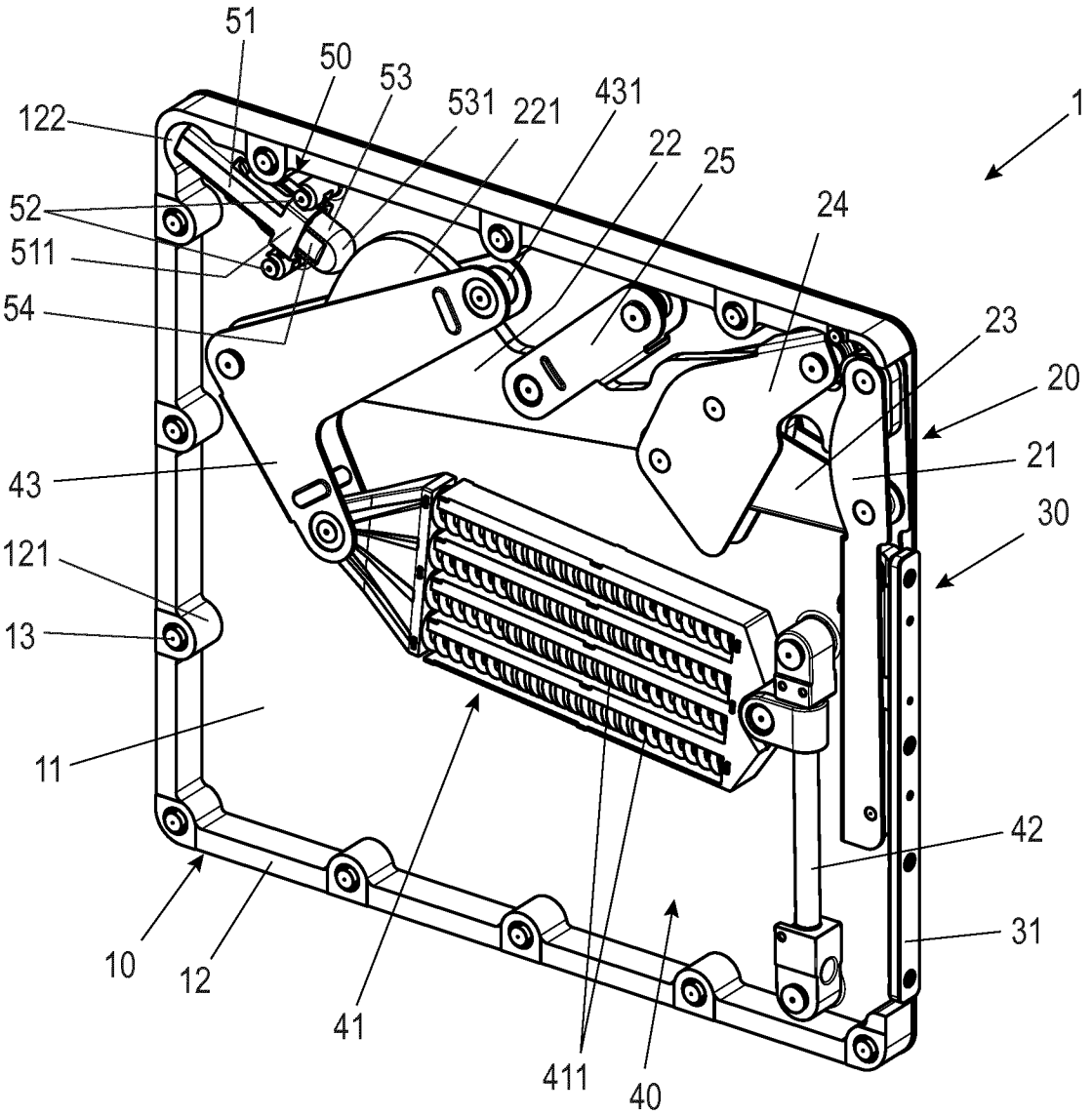

the wing fitting and includes an abutment against which one of the levers of the compound lever presses in order to damp the movement of the wing.

13 Claims, 26 Drawing Sheets

(51) Int. Cl.

| | |
|---|---|
| ***E05F 5/02*** | (2006.01) |
| ***E05D 3/16*** | (2006.01) |
| ***E05D 15/40*** | (2006.01) |
| ***E05F 1/10*** | (2006.01) |
| ***E05F 1/12*** | (2006.01) |

(52) U.S. Cl.
CPC ..... *E05F 1/1261* (2013.01); *E05D 2003/163* (2013.01); *E05Y 2201/10* (2013.01); *E05Y 2201/256* (2013.01); *E05Y 2201/264* (2013.01); *E05Y 2201/492* (2013.01); *E05Y 2600/10* (2013.01); *E05Y 2600/41* (2013.01); *E05Y 2900/20* (2013.01)

(58) Field of Classification Search
CPC ..... E05F 5/02; E05F 3/20; E05D 3/16; E05D 11/00; E05D 15/40; E05D 2003/163; E05Y 2201/10; E05Y 2201/256; E05Y 2201/21; E05Y 2201/264; E05Y 2201/47; E05Y 2201/492; E05Y 2900/20; E05Y 2900/202; E05Y 2600/10; E05Y 2600/41; A47B 2220/0072; Y10T 16/5383; Y10T 16/547; Y10T 16/5476
See application file for complete search history.

(56) References Cited

U.S. PATENT DOCUMENTS

| | | | | |
|---|---|---|---|---|
| 8,225,459 | B2 * | 7/2012 | Waltemate | E05D 3/16 16/366 |
| 8,321,996 | B2 * | 12/2012 | Hirtsiefer | E05D 15/46 16/286 |
| 8,572,811 | B2 * | 11/2013 | Lautenschlager | A47B 88/473 16/370 |
| 8,959,709 | B2 * | 2/2015 | Hasegawa | E05F 1/1261 16/65 |
| 9,464,473 | B2 * | 10/2016 | Baldreich | E05F 1/1058 |
| 9,739,081 | B2 * | 8/2017 | Stuke | E05F 5/006 |
| 10,221,597 | B2 | 3/2019 | Hammerer | |
| 10,246,915 | B2 * | 4/2019 | Brunnmayr | E05D 15/32 |
| 10,407,962 | B2 * | 9/2019 | Schluge | E05F 5/02 |
| 10,428,568 | B2 * | 10/2019 | Brunnmayr | E05F 1/105 |
| 10,590,688 | B2 * | 3/2020 | Salice | E05F 1/1041 |
| 10,900,269 | B2 * | 1/2021 | Holzapfel | E05F 1/1058 |
| 10,914,106 | B2 * | 2/2021 | Salice | E05F 3/104 |
| 2010/0162847 | A1 * | 7/2010 | Gassner | E05F 1/1058 74/490.07 |
| 2012/0260461 | A1 * | 10/2012 | Lautenschlager | A47B 88/473 16/352 |
| 2014/0317883 | A1 * | 10/2014 | Baldreich | E05F 1/1058 16/280 |
| 2014/0319987 | A1 * | 10/2014 | Blum | E05F 1/12 312/319.2 |
| 2017/0044812 | A1 * | 2/2017 | Schluge | F16H 21/44 |
| 2018/0087307 | A1 * | 3/2018 | Hammerer | E05F 5/006 |
| 2018/0291665 | A1 | 10/2018 | Güzeltepe et al. | |
| 2018/0363348 | A1 * | 12/2018 | Schluge | E05F 1/14 |

FOREIGN PATENT DOCUMENTS

| | | | | |
|---|---|---|---|---|
| DE | 102006044873 | A1 | 4/2008 | |
| DE | 202010015091 | U1 | 2/2012 | |
| DE | 202015102394 | U1 | 7/2015 | |
| DE | 202014102481 | U1 * | 8/2015 | E05F 5/04 |
| EP | 1818491 | A2 | 8/2007 | |
| EP | 3401482 | A1 * | 11/2018 | E05D 3/06 |
| WO | WO-2007042094 | A1 * | 4/2007 | E05F 5/02 |
| WO | 2016090391 | A1 | 6/2016 | |
| WO | 2016131770 | A1 | 8/2016 | |
| WO | 2017059982 | A1 | 4/2017 | |

OTHER PUBLICATIONS

Search Report dated Jul. 24, 2018 in related/corresponding DE Application No. 10 2017 126 369.1.
Written Opinion dated Jan. 23, 2019 in related/corresponding International Application No. PCT/EP2018/080315.

* cited by examiner

FLAP FITTING FOR A PIECE OF FURNITURE, SIDE WALL OF A BODY OF A PIECE OF FURNITURE AND PIECE OF FURNITURE COMPRISING A SIDE WALL

BACKGROUND AND SUMMARY OF THE INVENTION

Exemplary embodiments of the invention relate to a flap fitting for an item of furniture, comprising a lever mechanism having multiple levers for guiding a flap of the item of furniture and a damping unit having at least one damper for damping the flap as it approaches a closed end position. In this case, the damping unit is arranged inside a housing of the flap fitting and comprises a stop, against which one of the levers of the lever mechanism rests to damp the movement of the flap. Furthermore, the flap fitting comprises a spring unit, which acts via a pressure roller on a control section of the lever mechanism and holds the flap fitting in the closed and/or an open end position. Exemplary embodiments of the invention furthermore relate to a side wall of a furniture body and an item of furniture having a side wall.

Items of furniture, in particular kitchen furniture and/or living room furniture, such as base cabinets or hanging cabinets, generally have a furniture body open to the front, on which movable furniture parts guided via fittings are installed. In particular in the case of hanging cabinets, flaps are frequently used as movable furniture parts to close the furniture body, which flaps are mounted via at least one, generally two, laterally arranged flap fittings. The flap fittings enable opening upward (pivoting up) of the flap, wherein the flap can be pivotable, for example, around a horizontally extending imaginary pivot axis arranged in the upper region of the furniture body. Other upwardly oriented opening movements of a flap are also conceivable.

The lever mechanism of the flap fitting is typically formed in multiple parts as a multi-joint lever mechanism, so that a so-called door bearing lever, on which the flap is fastened, executes a combined pivoting and sliding movement or a pivoting movement that takes place around a pivot axis located outside the flap fitting and generally also outside the furniture body.

A flap fitting of the type mentioned at the outset is known from the document CN 204826984 U. In this flap fitting, a linear damper is coupled via a lever chain to one of the levers of the lever mechanism, which guides and supports a furniture flap. The coupling takes place, inter alia, via a guide curve, which is designed in such a way that the damper is only actuated and thus becomes active upon approach of the flap to the closed position. From a specific open position of the flap, the damper is not active and thus does not prevent a free movement of the flap. The lever chain for actuating the linear damper complicates the structure of the flap fitting, however.

Exemplary embodiments of the present invention are directed to a flap fitting of the type mentioned at the outset in which a movement into the closed end position is damped, wherein the damper is integrated into the flap fitting with the least possible effort. In this case, the flap fitting is to be able to be constructed as compactly as possible, so that it can also be integrated into a side wall of a furniture body. Exemplary embodiments are also directed to a side wall for a furniture body having a flap fitting and/or an item of furniture having such a side wall having these advantages.

A flap fitting according to the invention of the type mentioned at the outset is distinguished in that the stop of the damping unit during the closing of the flap fitting is actuated by the control section of the transmission lever of the lever mechanism.

According to the invention, a structurally simple coupling of the damper takes place in that the damper is designed and positioned in such a way that the control section of the transmission lever of the lever mechanism strikes a flap guided by the flap fitting during the approach to the closed end position. The part of the transmission lever used as the control section can thus additionally actuate the damper unit. The additional functionalities (attachment to the spring unit and/or attachment to the damping unit) require that the transmission lever protrude beyond the points of articulation by which it is coupled to other levers of the lever mechanism. If the protruding part fulfills both additional functionalities simultaneously, material and/or installation space can be saved.

The flap fitting can thus also be incorporated into a side wall of the furniture body or can be inserted into the side wall in a pocket incorporated from the front face of the side wall. Alternatively, it would also be possible to arrange the flap fitting in the side wall in such a way that at least one lateral wall of the flap fitting or a housing of the flap fitting nearly forms a plane with the side wall.

In one advantageous design of the flap fitting, in which the lever mechanism forms a seven-joint mechanism, a transmission lever of the lever mechanism, which is connected at three points of articulation to further levers of the lever mechanism, is the lever with which the damping unit interacts. This lever of the seven-joint mechanism executes a combined sliding and pivoting movement, wherein in particular during approach to the closed end position, the component of the pivoting movement is small in comparison to the component of the sliding movement. A linear damper can thus advantageously be used in the damping unit and when it rests against the transmission lever, it slips only slightly or not at all along the stop.

In a further advantageous design of the flap fitting, the damping unit comprises a receptacle for the damper, wherein the receptacle comprises guide means to guide a carriage, on which the stop is formed. The damper is preferably designed as a linear damper having a cylinder and a piston having piston rod. The cylinder can be coupled in this case to the receptacle and the piston rod can be coupled to the carriage or vice-versa the cylinder can be coupled to the carriage and the piston rod can be coupled to the receptacle. In this manner, a commercially available damper can be used, wherein the stop is formed in suitable size and shaping on the carriage. Force components possibly acting transversely to the movement direction of the piston rod (for example, due to a pivoting movement component of the lever with which the damping unit interacts) are absorbed by the guide and do not act on the linear damper, which could otherwise result in leaks of the damper.

In a further advantageous design of the flap fitting, the housing comprises two parallel side plates, which are spaced apart from one another by an interposed frame. The damping unit can be installed on at least one of the side plates or on the frame in this case. In one preferred design, the damping unit can be integrated into the frame, for example, by the receptacle of the damping unit being formed integrally with the frame. The construction and the installation of the flap fitting are thus further simplified.

In a further advantageous design of the flap fitting, the side plates of the housing have an inside spacing that is less than 16 mm (millimeters) and is preferably less than 14 mm.

Such a flap fitting can be integrated into a side wall of a furniture body, which typically has a thickness of 15 mm to approximately 25 mm.

A side wall according to the invention for a furniture body is accordingly distinguished in that such a flap fitting is inserted or integrated. An item of furniture according to the invention having a furniture body and a guided flap is distinguished by such a furniture body having at least one side wall having inserted or integrated flap fitting. The advantages mentioned in conjunction with the flap fitting result.

BRIEF DESCRIPTION OF THE DRAWING FIGURES

Figure 1B:
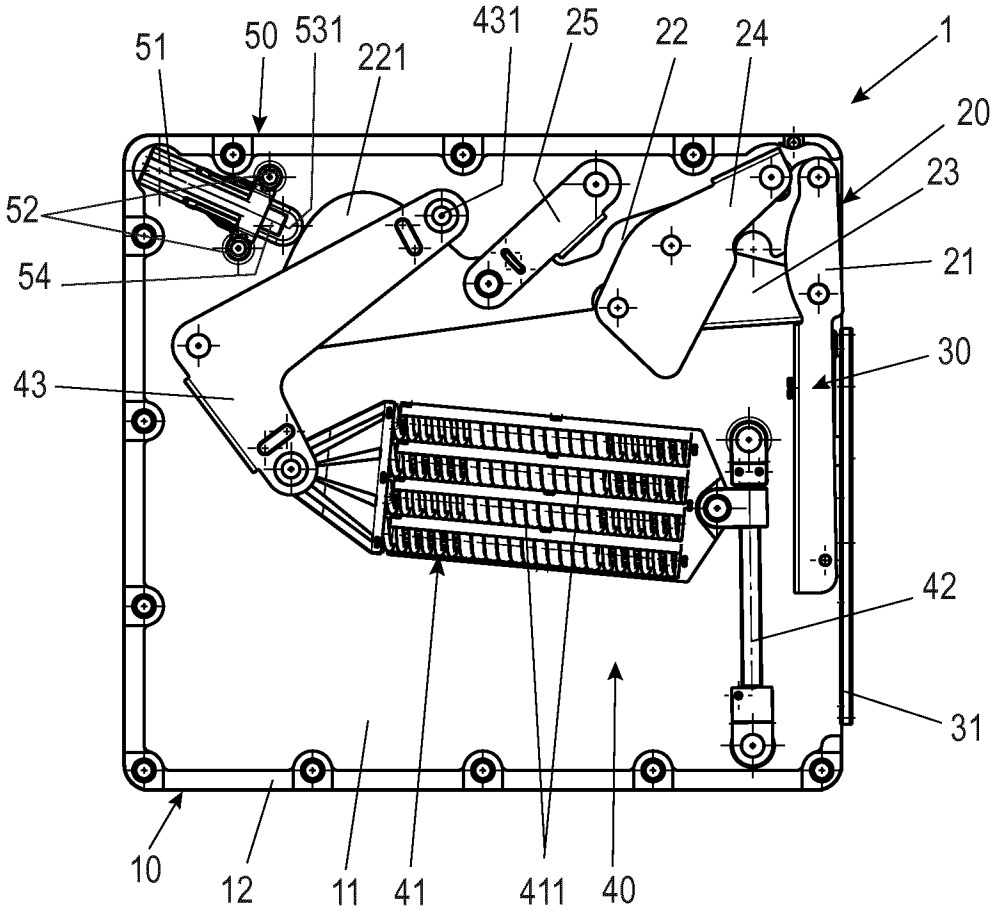
Figure 2A:
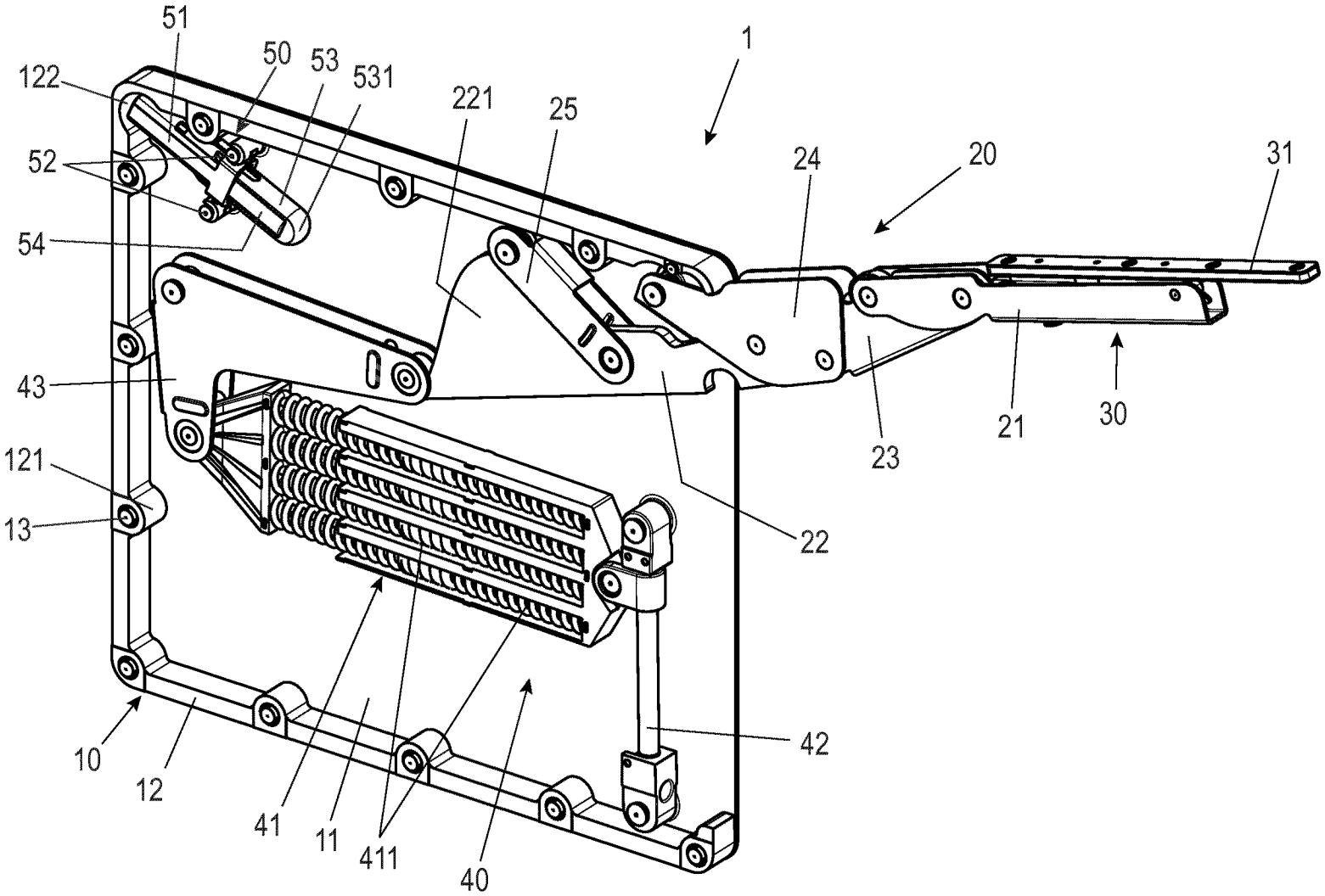
Figure 2B:
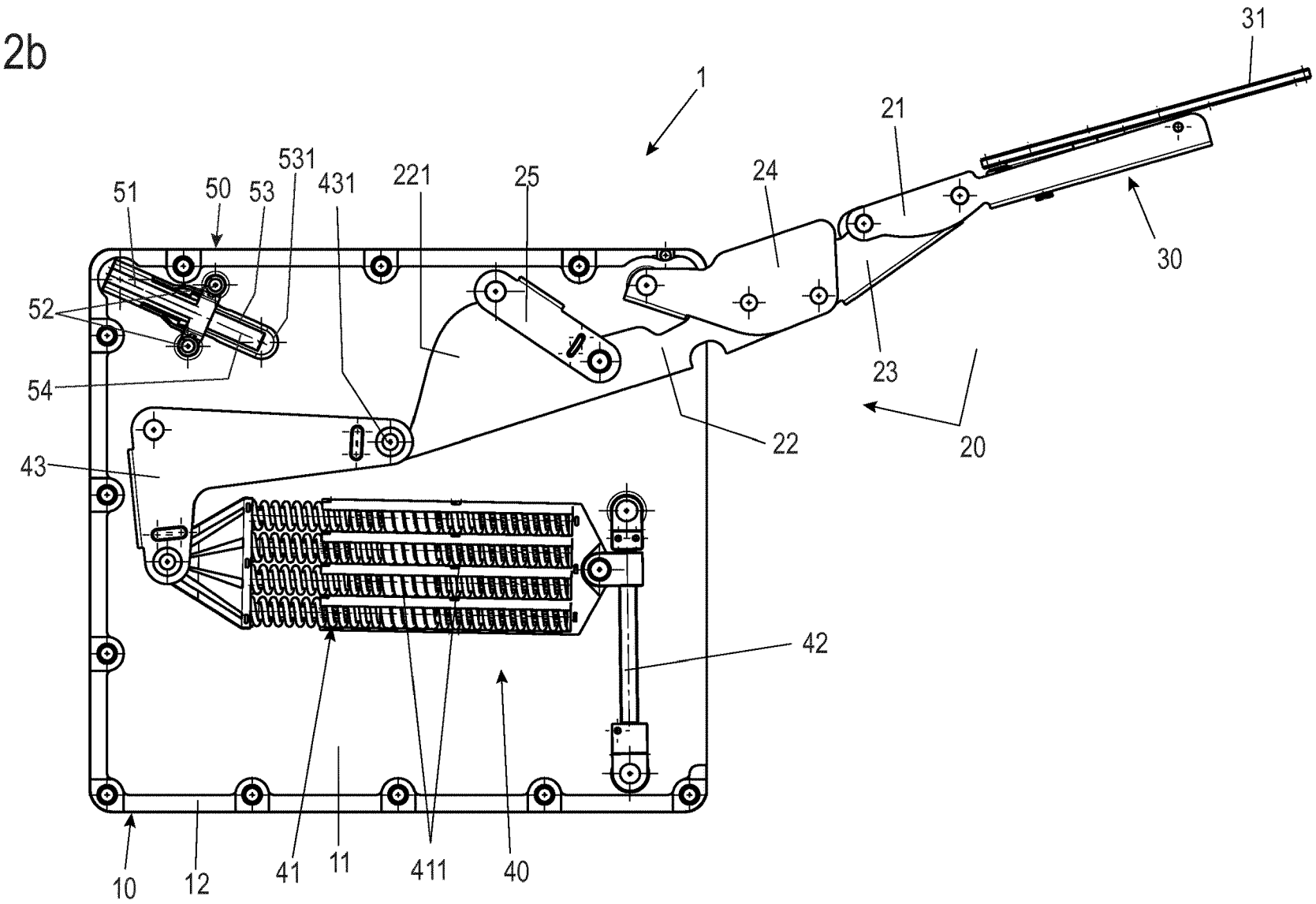
Figure 3A:
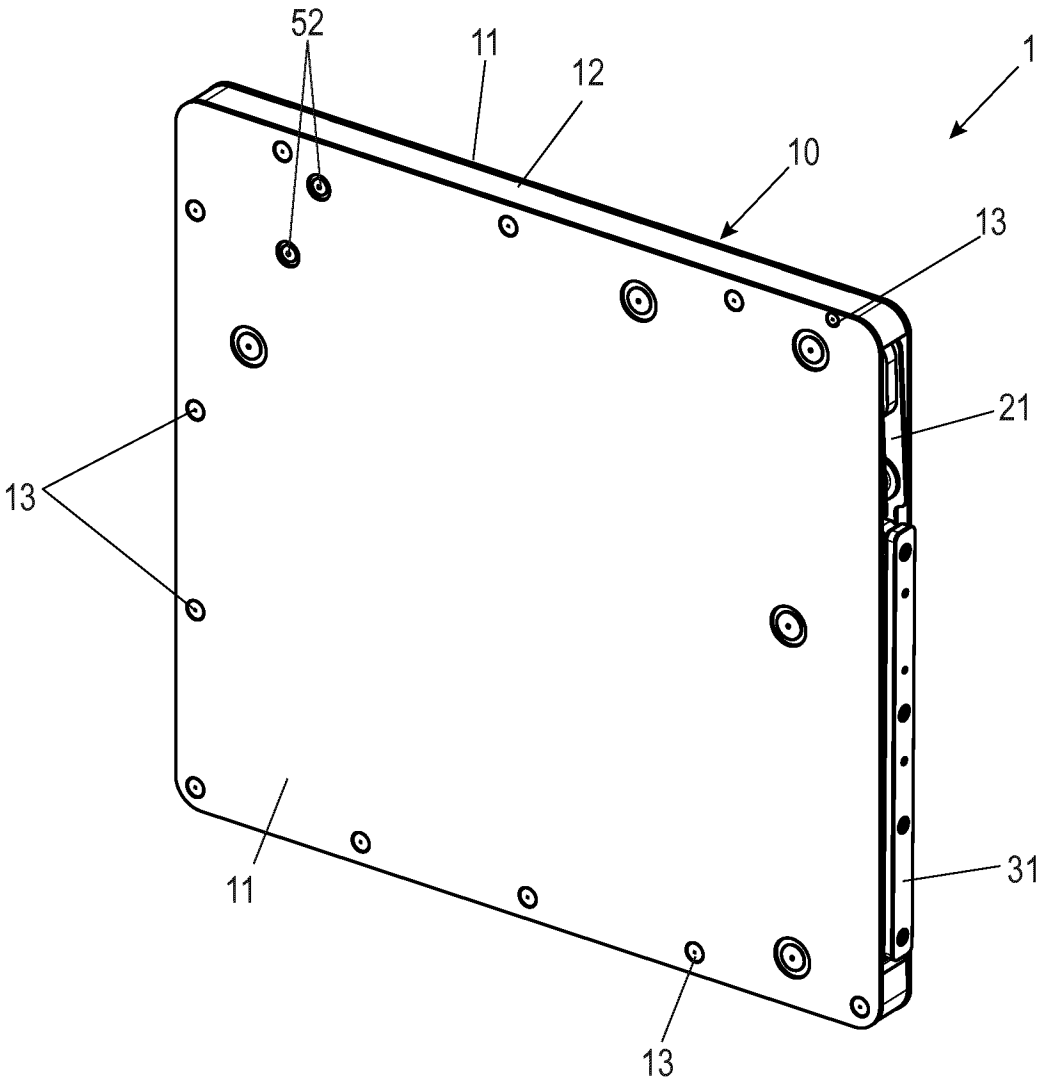
Figure 3B:
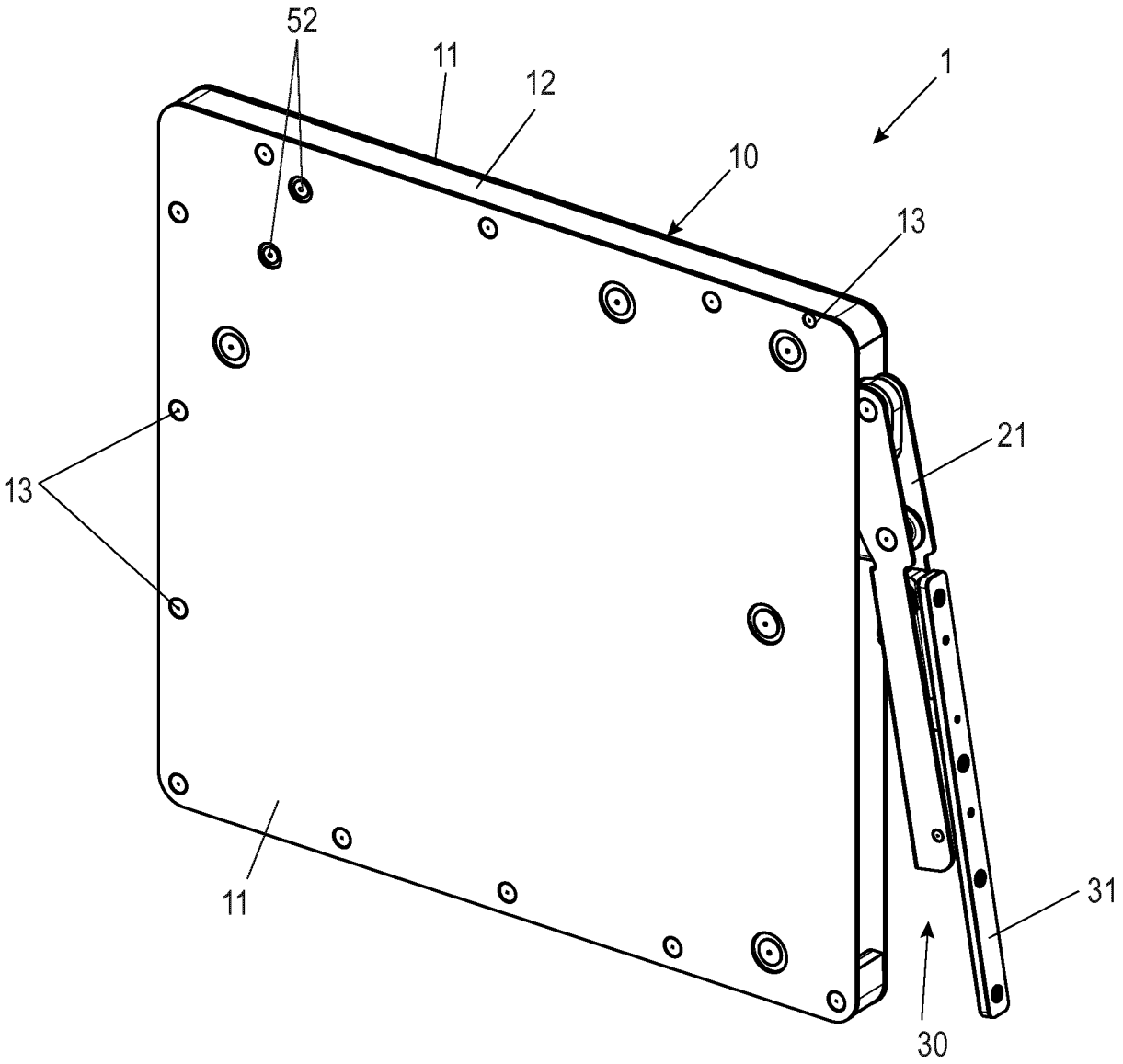
Figure 4:
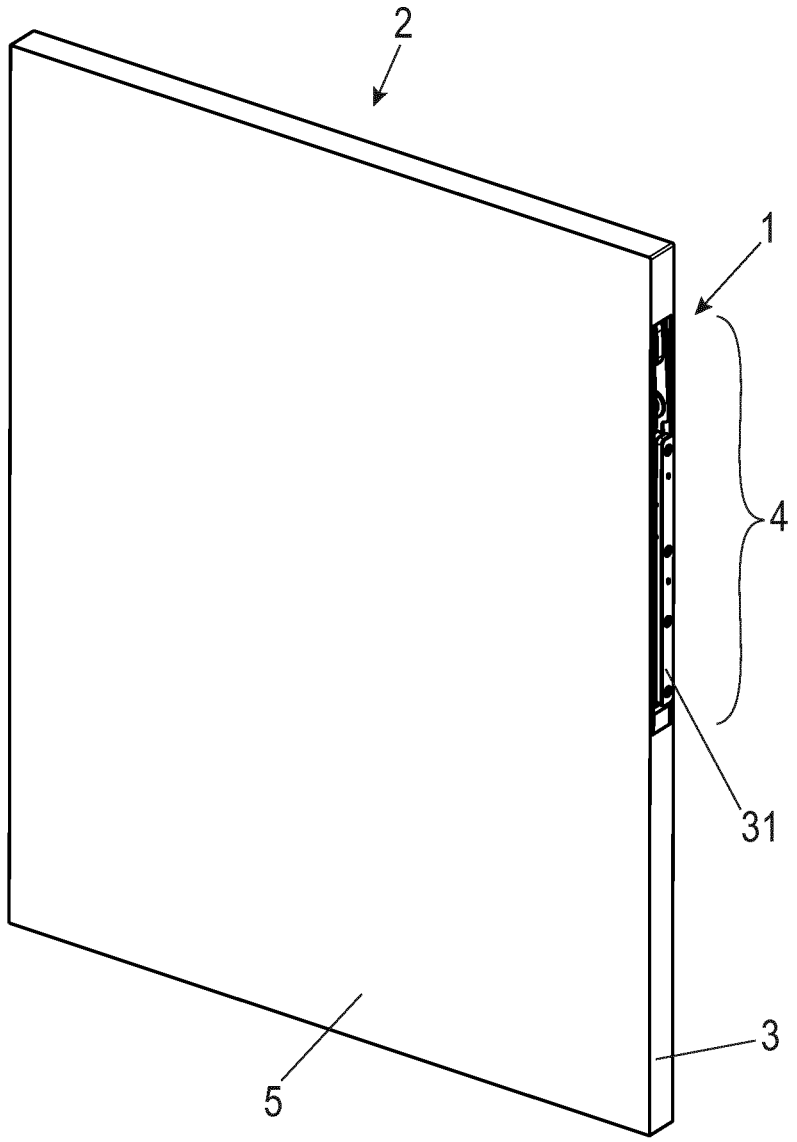
Figure 5A:
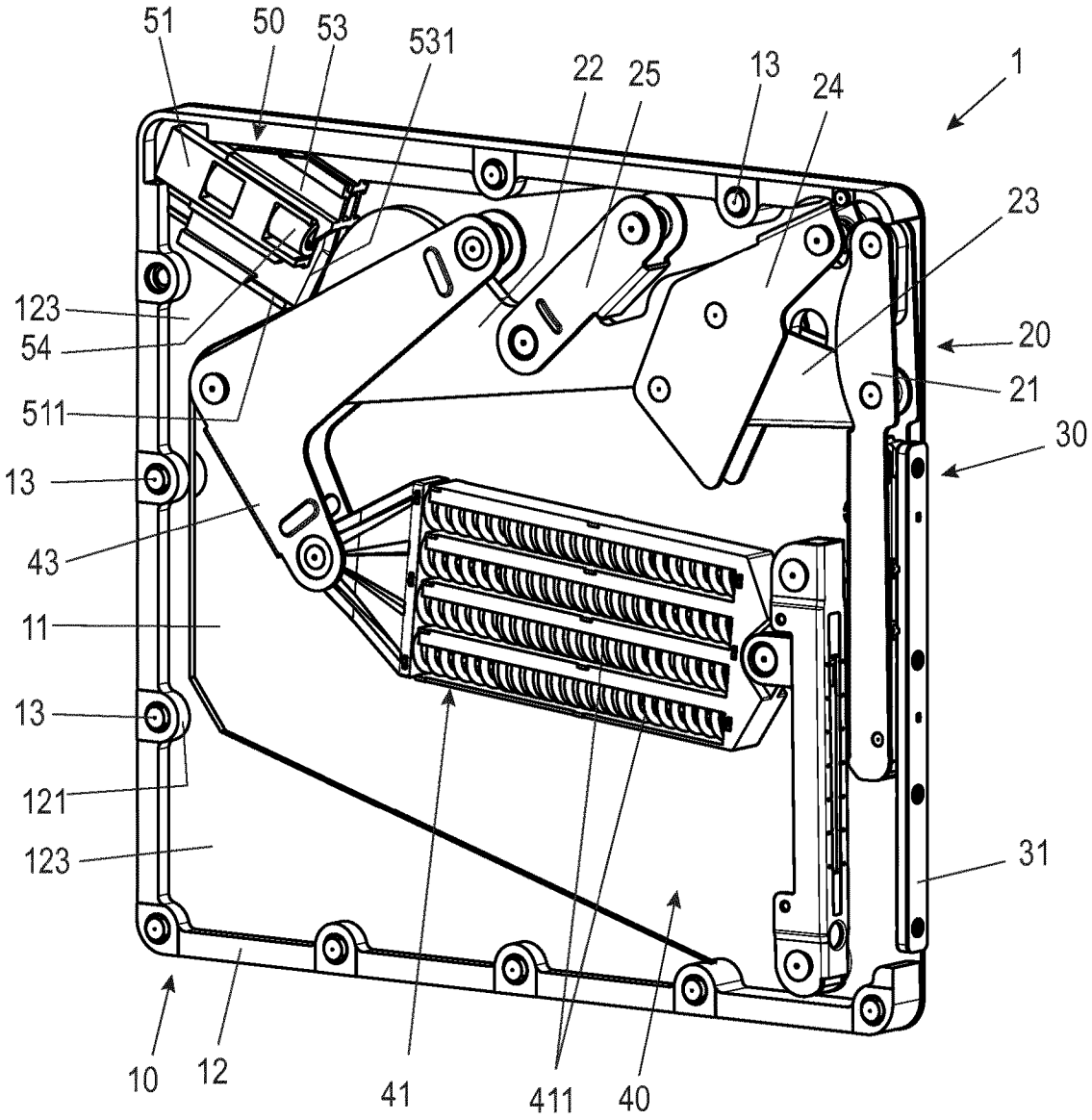
Figure 6A:
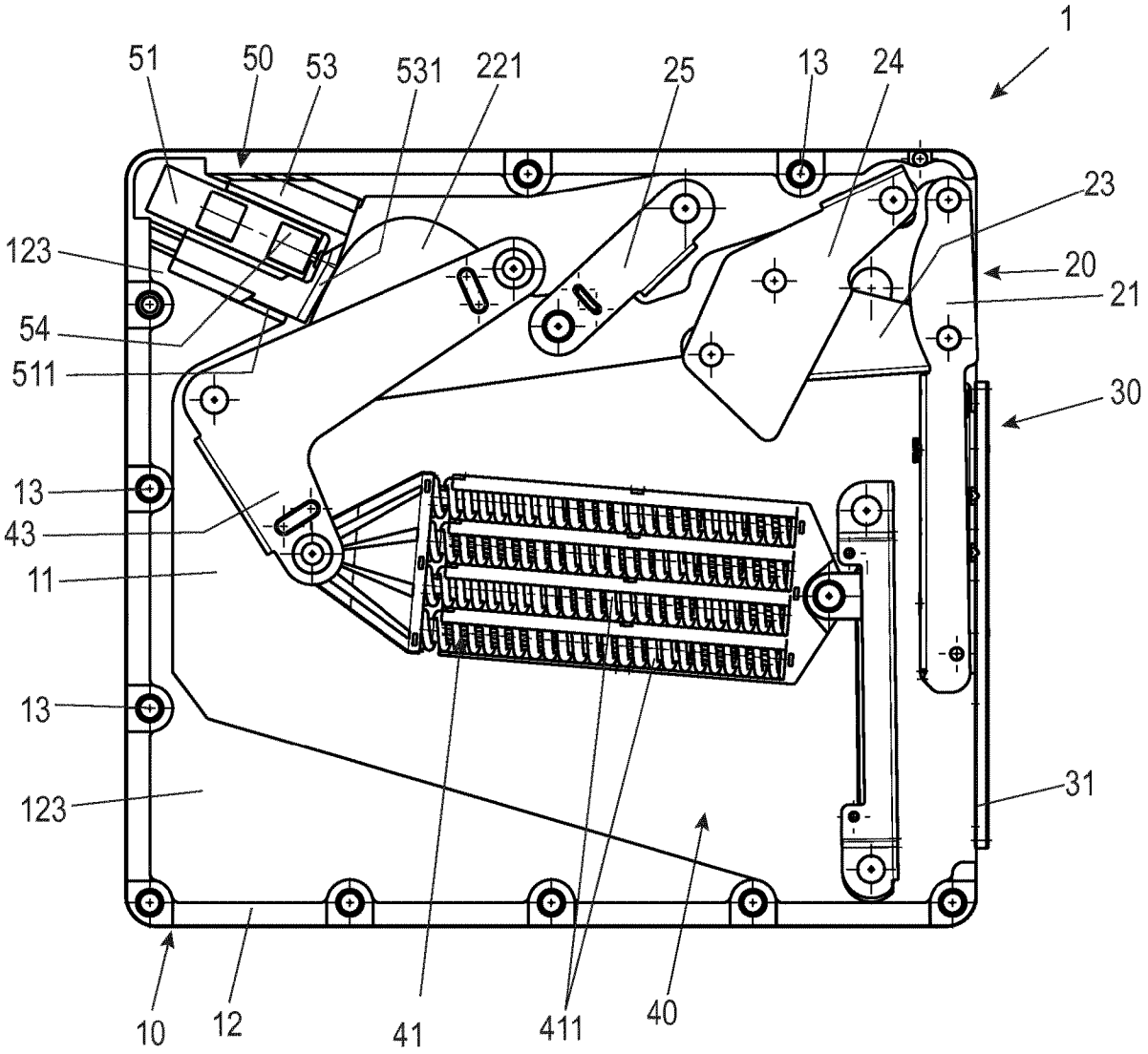
Figure 6B:
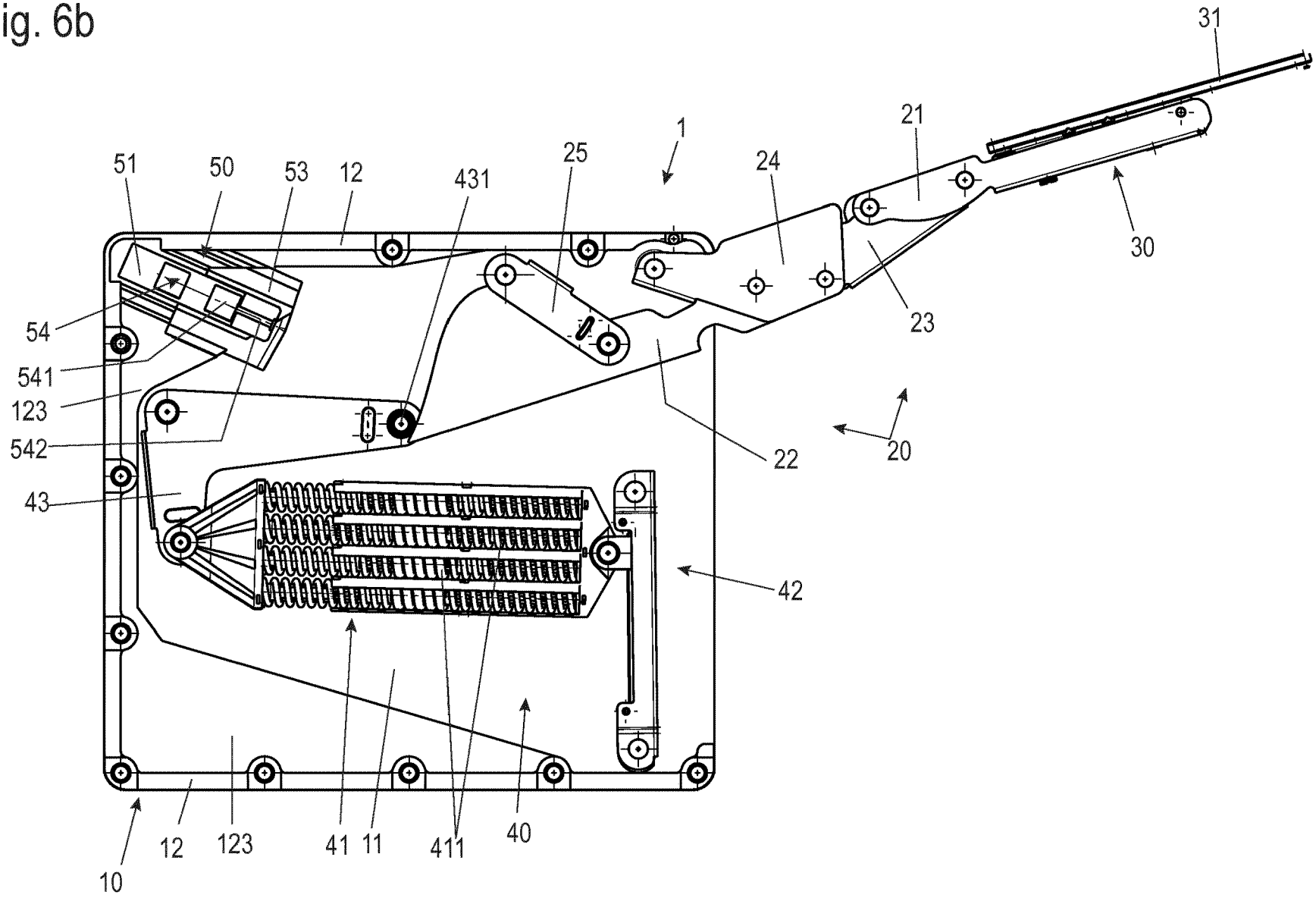
Figure 6C:
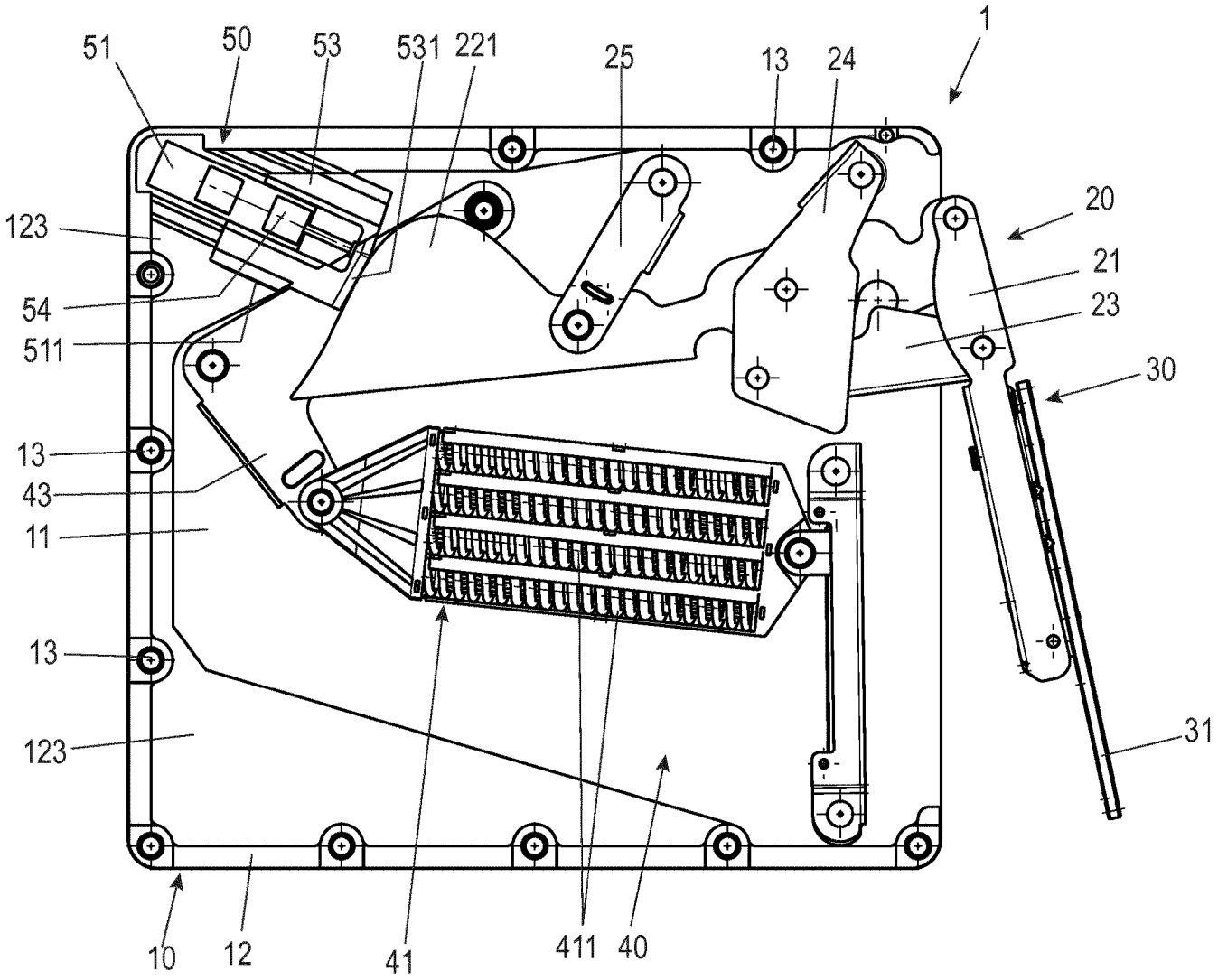
Figure 7:
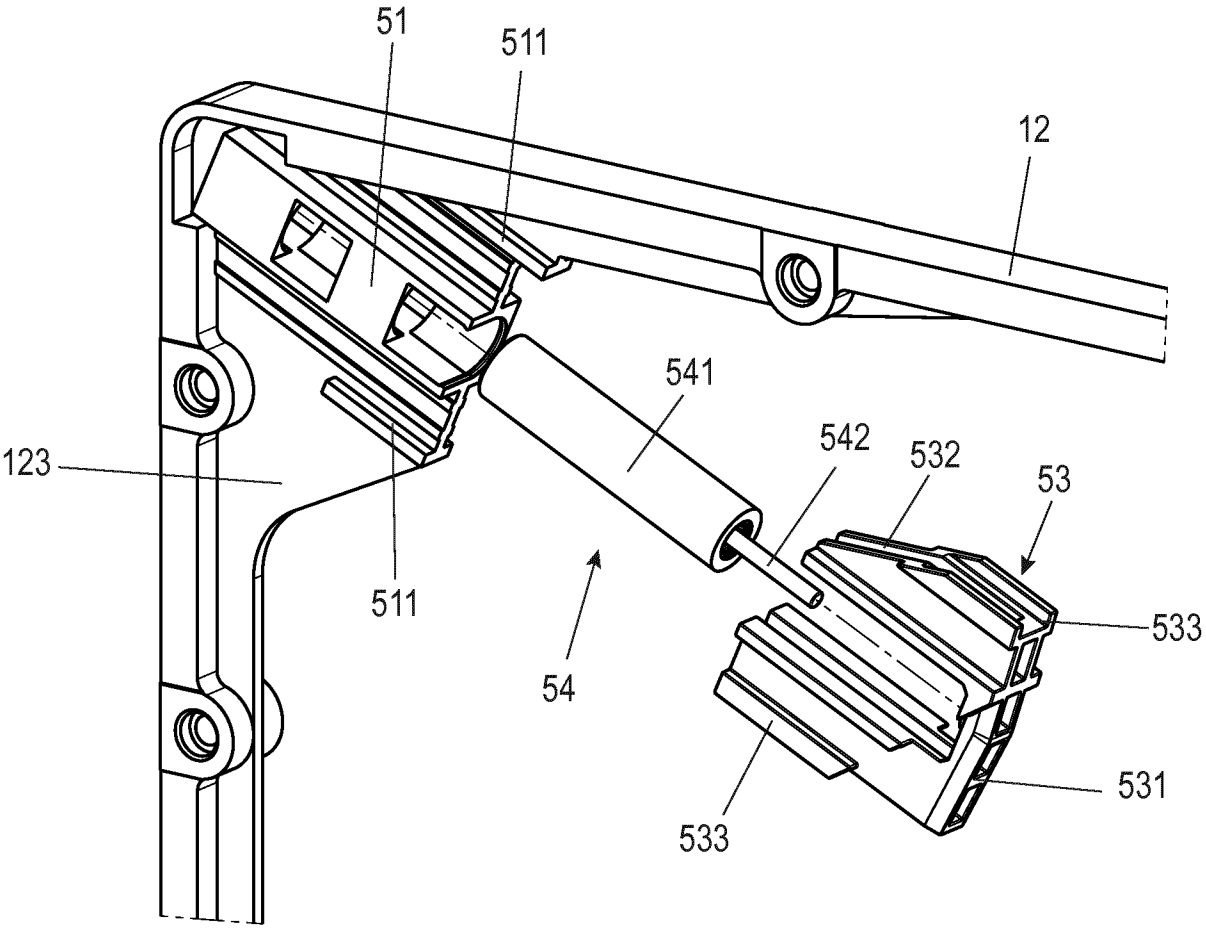
Figure 8A:
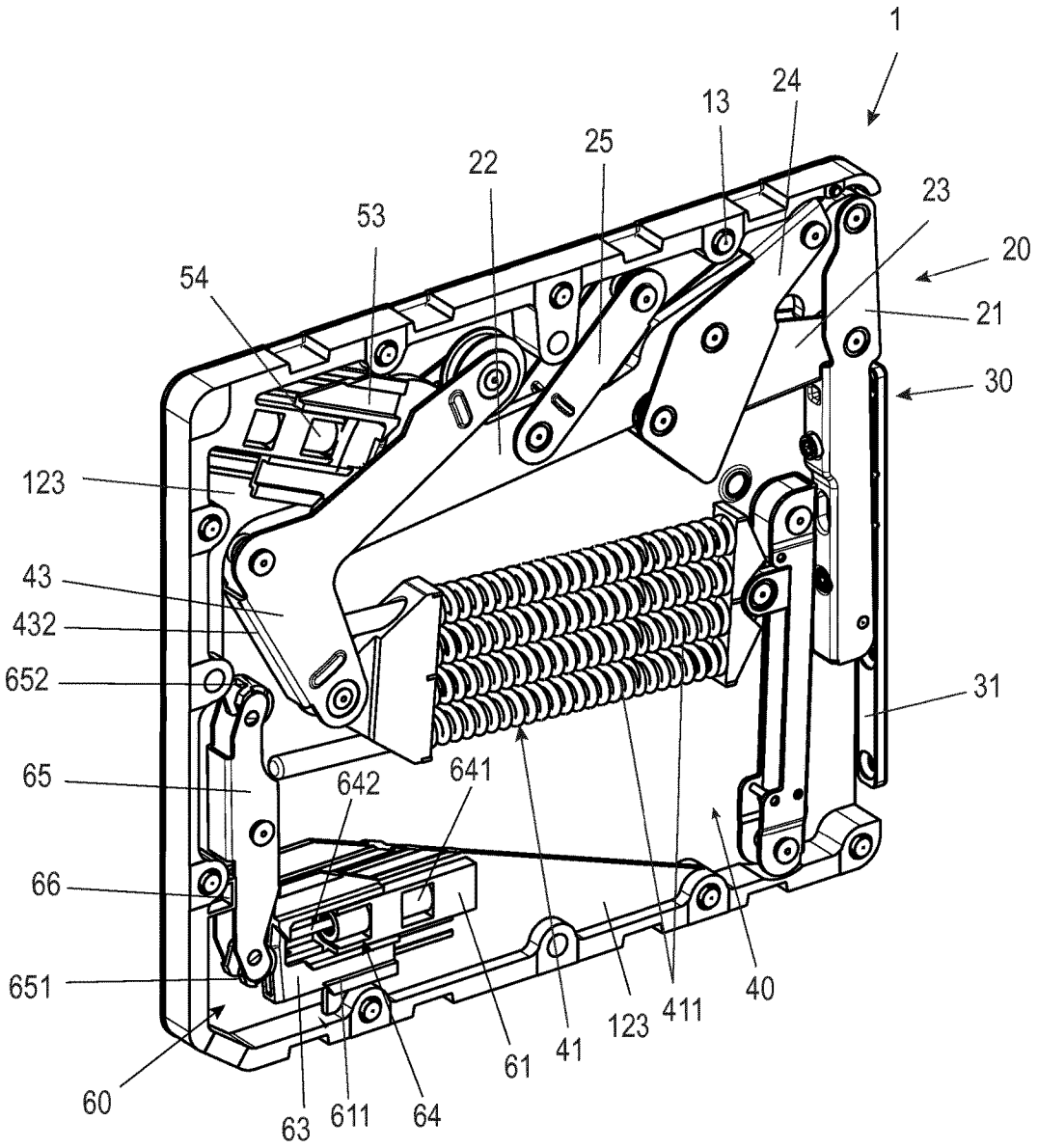
Figure 8B:
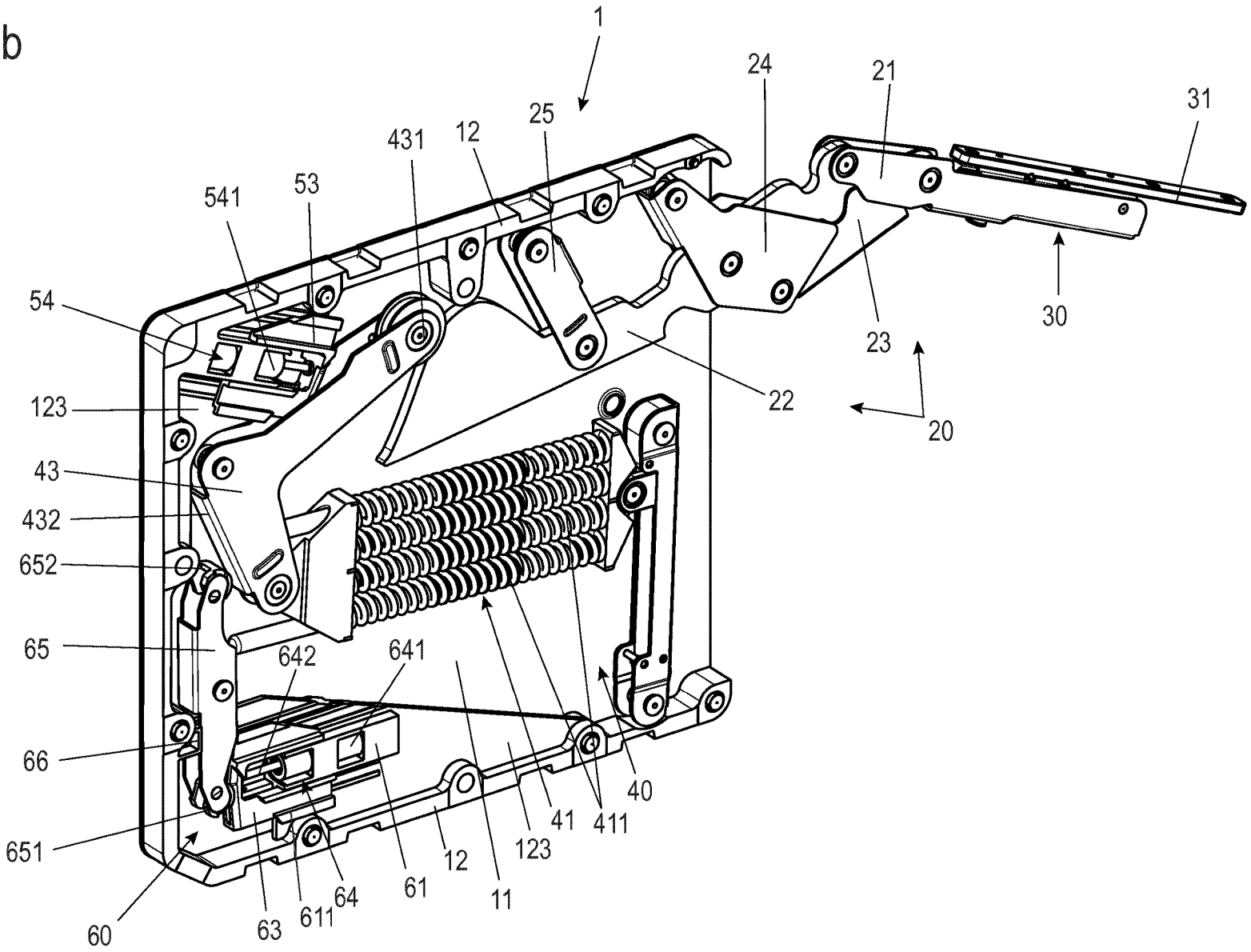
Figure 8C:
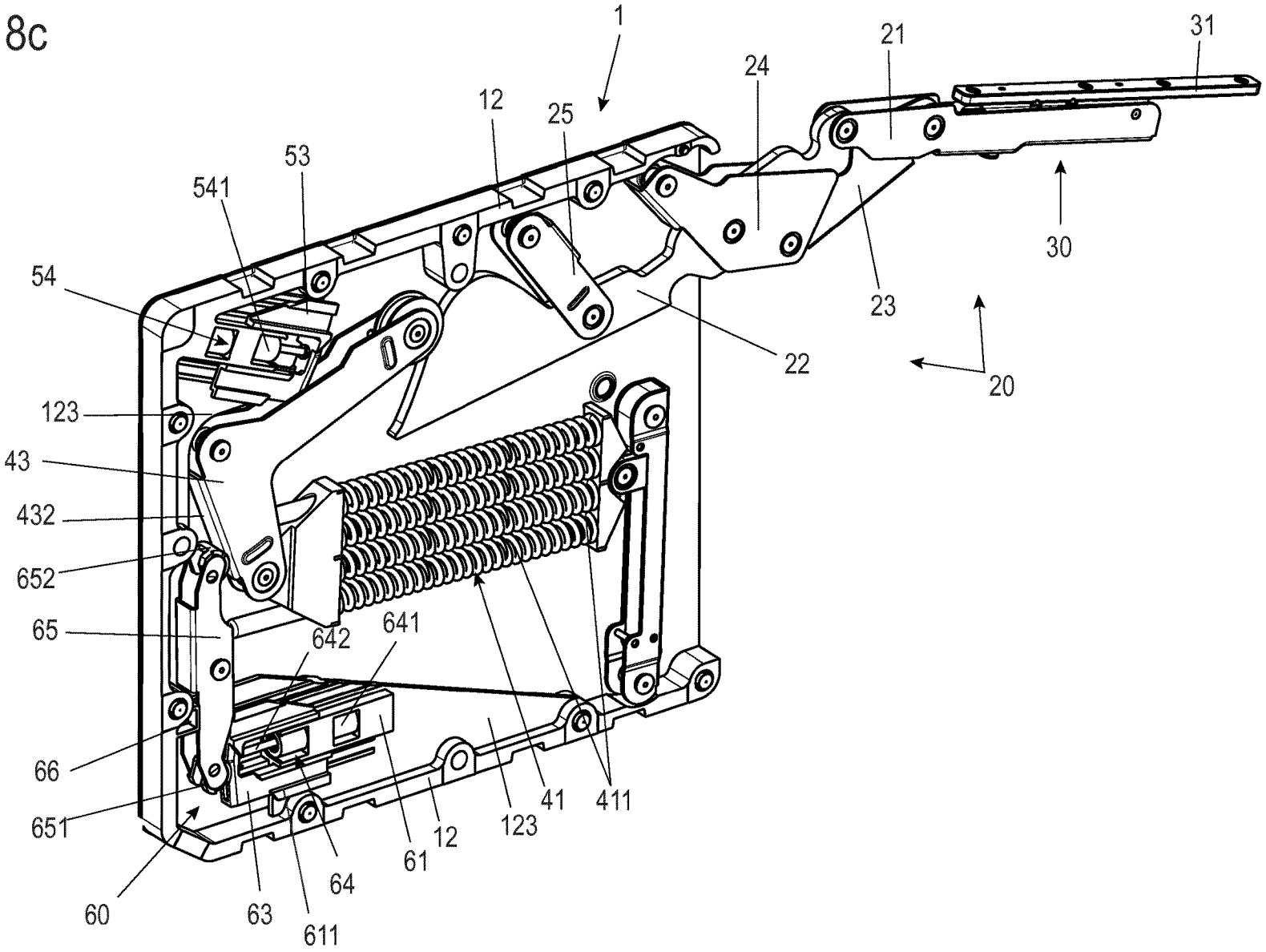

The invention is explained in greater detail hereafter on the basis of exemplary embodiments with the aid of figures. In the figures:

FIGS. 1*a*, 1*b* show an isometric view and a side view of an exemplary embodiment of a flap fitting in a closed position having open housing;

FIGS. 2*a*, 2*b* show the flap fitting of FIGS. 1*a* and 1*b* in an isometric view or a side view, respectively, in an open position;

FIGS. 3*a*, 3*b* show the flap fitting of the preceding figures having closed housing in a closed (FIG. 3*a*) and a partially open (FIG. 3*b*) position;

FIG. 4 shows a side plate of a furniture body having an integrated flap fitting in an isometric view;

FIGS. 5*a, b* show an isometric view of a second exemplary embodiment of a flap fitting in a closed position (FIG. 5*a*) and an open position (FIG. 5*b*) having open housing;

FIGS. 6*a, b* show a side view of the second exemplary embodiment of the flap fitting in the closed position (FIG. 6*a*) and the open position (FIG. 6*b*) having open housing;

FIGS. 6*c, d* show the flap fitting according to FIGS. 6*a* and *b* in two different intermediate positions;

FIG. 7 shows a detail view of a frame of the flap fitting of the second exemplary embodiment having damping unit in an isometric exploded illustration;

FIGS. 8*a-c* each show an isometric view of a third exemplary embodiment of a flap fitting in a closed position (FIG. 8*a*) and two partially-open positions (FIGS. 8*b, c*) having open housing;

FIGS. 9*a-e* each show a side view of the third exemplary embodiment of the flap fitting in a closed position (FIG. 9*a*), an open position (FIG. 9*b*), and a series of intermediate positions (FIG. 9*c-e*); and FIGS. 10*a-d* each show a side view of a fourth exemplary embodiment of a flap fitting in a closed position (FIG. 10*a*), a completely open position (FIG. 10*d*), and two intermediate positions (FIG. 10*b, c*) having open housing.

DETAILED DESCRIPTION

A first exemplary embodiment of a flap fitting 1 is illustrated in a closed position (FIGS. 1*a*, 1*b*) and a completely open position (FIGS. 2*a*, 2*b*) of a flap (not shown here) guided by the flap fitting 1 in FIGS. 1*a* and 1*b* and 2*a* and 2*b*. FIGS. 1*a* and 2*a* show the flap fitting in an isometric illustration and FIGS. 1*b* and 2*b* show it in a side view.

In the description, terms such as top, bottom, left, right refer exclusively to the exemplary illustration selected in the respective figures. The terms front and rear are generally in relation to an opening movement of the guided flap. The front side is a side facing toward the user in this case.

A housing 10 of the flap fitting 1 is shown in each of FIGS. 1*a*, 1*b* and FIGS. 2*a*, 2*b* open on one side to be able to illustrate the internal structure of the flap fitting 1. In FIGS. 3*a* and 3*b*, the flap fitting 1 having closed housing is shown in two different closed positions in an isometric view in each case. In all figures, identical reference signs identify identical elements. For reasons of clarity, in the figures, not every element is provided with a reference sign in all figures.

The housing 10 is formed in the present case from two side plates 11, of which only the rear one is shown in the figures. The side plates 11 are spaced apart from one another and aligned in parallel to one another by a partial circumferential frame 12. A plurality of rivets 13 (cf. FIGS. 3*a*, 3*b*), using which the housing 10 and thus the flap fitting 1 is held together, lead through the side plates 11 and the frame 12. Instead of the rivets, other fastening means, for example, screws, can also be used. The rivets 13 lead through widened sections 121 of the frame 12. Of course, the housing 10 can also be manufactured in another manner, for example, by a deep drawing method or a bending method. It is essential for the housing 10 that the forces of the flap fitting 1 can be absorbed. The housing 10 produced by deep drawing, for example, would also have side walls 11, which are aligned in parallel to one another.

In the illustrated flap fitting 1, all further components are fastened on the side plates 11, for example, also using rivets or bolts which lead through one or both of the side plates 11.

The flap fitting 1 comprises a lever mechanism 20 having five levers, which are connected to one another and/or to the housing 10 in seven points of articulation. The flap fitting 1 is thus designed as a seven-joint mechanism, wherein the flap fitting can alternatively also be embodied as a four-joint mechanism or as another articulated arrangement. The lever mechanism 20 comprises a door bearing lever 21 as the outermost element of the lever mechanism 20, which is connected via an adjustment unit 30 to an installation plate 31. The flap to be guided by the flap fitting 1 is installed on this installation plate 31. The adjustment unit 30, which is illustrated in greater detail in following figures, enables an adjustment movement of the installation plate 31 and thus of the guided flap in relation to the door bearing lever 21.

The door bearing lever 21 is rotatably connected to a transmission lever 22 at the upper point of articulation in FIGS. 1*a*, 1*b*. The door bearing lever 21 is connected to a deflection lever 23 in a lower point of articulation in the figures. The deflection lever 23 and the transmission lever 22 are in turn linked to a control lever 24. The transmission lever 22 is connected at its rear end to a support lever 25, wherein the support lever 25 is in turn rotatably mounted on the housing 10. This lever mechanism 20 thus results in a seven-joint chain.

As is apparent from FIGS. 2*a* and 2*b*, the individual levers of the lever mechanism 20 are shaped in such a way that they form an approximately stretched arrangement in the open position of the flap. During the opening or closing procedure, the outer element of the lever mechanism 20, the door bearing lever 21, executes a combined rotational and translational movement, by which an installed flap is not only pivoted, but rather is moved forward in such a way that it can be guided with its edge over a body edge.

The flap fitting 1 furthermore comprises a spring unit 40, which holds the flap in a spring-loaded manner both in the closed and also in the completely open state. In particular in the completely open state, the spring unit 40 is capable of compensating for the weight of the flap, so that it remains in the open position without a further locking lever. In principle, intermediate positions can also be provided, in which torques exerted by the weight of the flap on the flap fitting are also compensated for in such a way that the flap remains in these positions.

The spring unit 40 comprises a spring assembly 41 having a plurality of compression springs 411. A right side of the spring assembly 41 in the figures is mounted on a spindle unit 42 so it is adjustable in its position. A side of the spring assembly 41 on the left in the figures acts on a shorter end of an angled intermediate lever 43, which is formed as a two-sided lever and is pivotably fastened on the housing 10. A pressure roller 431, which acts on a control section 221 of the transmission lever 22, is attached to the end of the second, free lever arm of the intermediate lever 43.

The control section 221 extends in a cup shape at its edge having a rising flank (left side of the control section 221 in the figures) and a falling flank (right side of the control section 221 in the figures). When the pressure roller 431 presses against the falling flank, a pressure of the pressure roller 431 has the result of moving the lever mechanism 20 in the direction of the closed position. The installed flap is accordingly pulled closed and/or held closed. During the opening movement, a dead center is passed through when the pressure roller is located just at the tip of the control section 221. In the further course of the opening movement, the pressure roller 431 presses against the rising flank of the control curve, wherein the pressure of the pressure roller 431 has the result of moving the lever mechanism 20 further in the direction of the opening position. The opening movement is correspondingly assisted, and the flap is held in the open position. Depending on the design of the control curve, the flap can also automatically open in a defined angle range.

The suspension point of the spring assembly 41 can be moved by means of the spindle unit 42 and the pre-tension of the compression springs 411 can thus be varied to adapt the contact pressure force of the pressure roller 431 to the weight and the size of the flap.

A side wall 2 of a furniture body (not shown in greater detail) is shown in FIG. 4, in which a flap fitting 1 according to the application, for example, as shown in FIGS. 1*a* to 3*b*, is integrated. A furniture body generally comprises at least two such side walls 2, wherein a corresponding flap fitting 1 according to the invention is integrated in both of them. The two—or possibly further flap fittings 1, which are integrated into intermediate walls of the furniture body—support a flap closing the furniture body to the front.

An opening 4, through which the lever mechanism 20 of the flap fitting 1 extends, is formed in a front end face 3 of the side wall 2. The flap fitting 1 is either inserted into the side wall 2 through the opening 4 into a receptacle formed behind this opening or is already integrated into the side wall 2 during the production thereof or is inserted laterally through a pocket, which is introduced from a side surface 5 and comprises an opening 4 on the end face 3. In all cases, the flap fitting 1 is integrated into the side wall 2, wherein at least in the first two cases, the flap fitting is covered on its sides by side surfaces 5 of the side wall 2 and is therefore not visible from the outside or from the inside of the furniture body. It is essential here that the flap fitting 1 and the side wall 2 form a unit, and the side wall 2 having inserted flap fitting has no or almost no thickness difference.

To be integrated into the side wall 2 of the furniture body, the thickness of the flap fitting 1, i.e., the outer spacing of the side plates 11, is strongly restricted by specifications with respect to the wall thickness of the furniture body. In the case of typical side walls of furniture bodies having a thickness of 16 mm (millimeter), the thickness of the flap fitting 1 is necessarily less than 16 mm and is preferably less than or equal to 14 mm. The lever mechanism 20 including the adjustment unit 30 is accordingly designed in such a way that it can be inserted between the two side plates 11 which have this spacing.

The adjustment unit 30 shown enables a lateral adjustment (sideways and vertical adjustment independent of one another) and an inclination adjustment of an installed flap. Moreover, the flap having an installed part of the flap fitting can easily be separated from the remaining part of the flap fitting, which simplifies the installation of the flap on the flap fitting 1 and the furniture body.

Furthermore, a damping unit 50 is provided, which acts on the lever mechanism 20 and thus decelerates the door bearing lever 21 and therefore a connected flap during the approach to the closed state, also called the closed end position.

The damping unit 50 comprises a receptacle 51, which is arranged and fastened via fastening means 52, in the present case rivets, which are guided through both side plates 11 comparably to the rivets 13, so that the damping unit 50 is arranged and fastened between the two side plates 11.

The receptacle 51 is used to accommodate a damper, which is designed as a linear damper 54 in the present case. Furthermore, guide means 511 are formed on the receptacle 51, which guide a slide 53 that is linearly displaceable in relation to the receptacle 51. The slide 53 comprises a stop 531 on its front side facing away from the receptacle 51, against which a lever of the lever mechanism 20 strikes when the door bearing lever 21 and/or the flap approaches the closed end position.

In the illustrated exemplary embodiment, the lever which strikes against the stop 531 is the transmission lever 22, which is rotatably coupled in three points of articulation to further levers of the lever mechanism 20, specifically the door bearing lever 21, the control lever 24, and the support lever 25.

The transmission lever 22 executes a movement in the housing 10 during the closing of the door bearing lever 21 and/or the attached flap. Accordingly, the damping unit 50 is arranged in a rear upper region of the housing 10 viewed from the opening of the housing 10. In the illustrated example, the frame 12 comprises a recess 122 in the corresponding corner to provide sufficient space for the damping unit 50.

In this rear region, the transmission lever 22 comprises the control section 221, on which the pressure roller 431 of the spring unit 40 acts. The transmission lever 22 strikes against the stop 531 with this control section 221.

In principle, levers other than the transmission lever 22 of the lever mechanism 20 can also be provided for interaction with the damping unit 50 and the stop 531. The transmission lever 22 advantageously suggests itself in the lever mechanism 20 shown in the exemplary embodiment, since it carries out a superimposed pivoting and sliding movement, wherein the sliding movement dominates particularly in the damped section of the movement and the pivoting movement is small. This advantageously has the result that the contact point of the stop 531 on the control section 221 only moves minimally along the control section 221 in the damped movement section, whereby only minor lateral forces act on the slide 53 and thus on the damper or the damper piston rod. Large lateral forces acting on the slide 53 strain the guide 511 between the receptacle 51 and the slide 53 and would result in stronger wear and possibly also noise generation and in particular would damage the damper.

As can be seen in FIGS. 2*a* and 2*b*, the linear damper 54 is extended from the damping unit 50 in an unloaded state, whereby the slide 53 is also maximally extended. The linear damper 54 is connected to the slide 53 in the illustrated exemplary embodiment using its cylinder visible (but not provided with a reference sign for the sake of clarity) in FIGS. 2*a* and 2*b*, while in contrast a piston rod (not visible in the figures) is coupled to the receptacle 51.

The linear damper 54 preferably comprises an internal spring that extends when it is not loaded. A coupling, for example, between the piston rod and the receptacle 51, accordingly does not require a fixed connection—the piston rod can press with its end on a stop in the receptacle 51. In principle, an inverted arrangement of the linear damper 54 is possible, in which the cylinder is fixed in the receptacle 51 and the piston rod interacts with the slide 53. An external spring is also conceivable, which is designed to move the linear damper 54 back into the starting position for the next damping procedure.

A second exemplary embodiment of a flap fitting, which corresponds with respect to its basic structure and in particular its lever mechanism 20 to the first exemplary embodiment, is illustrated in FIGS. 5*a* and 5*b*, 6*a-d* and 7. Reference is explicitly made to the description of the first exemplary embodiment. In all figures, identical reference signs identify identical or identically acting elements. In particular the differences between the two exemplary embodiments are explained in greater detail hereafter.

Figure 5B:
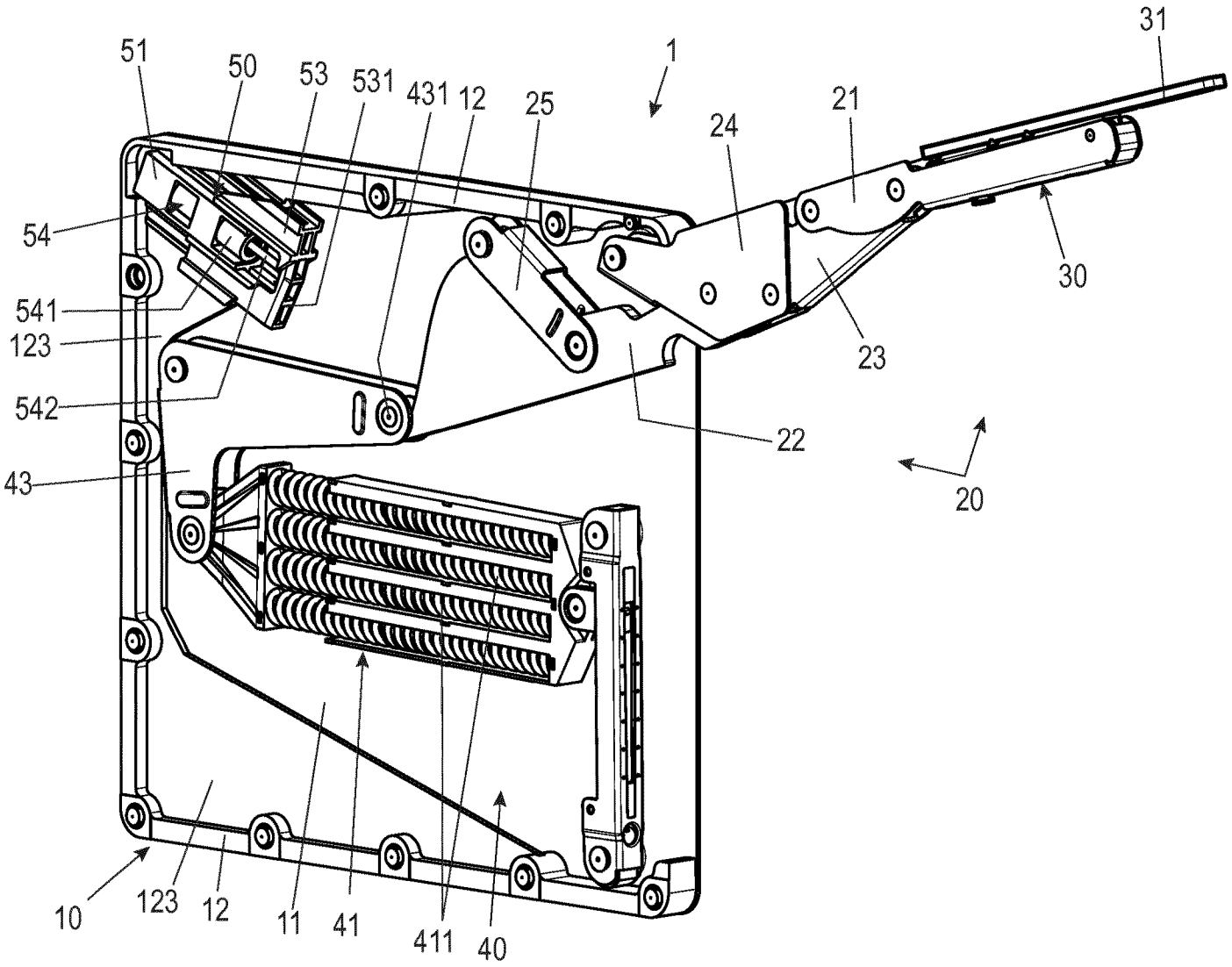
Figure 6D:
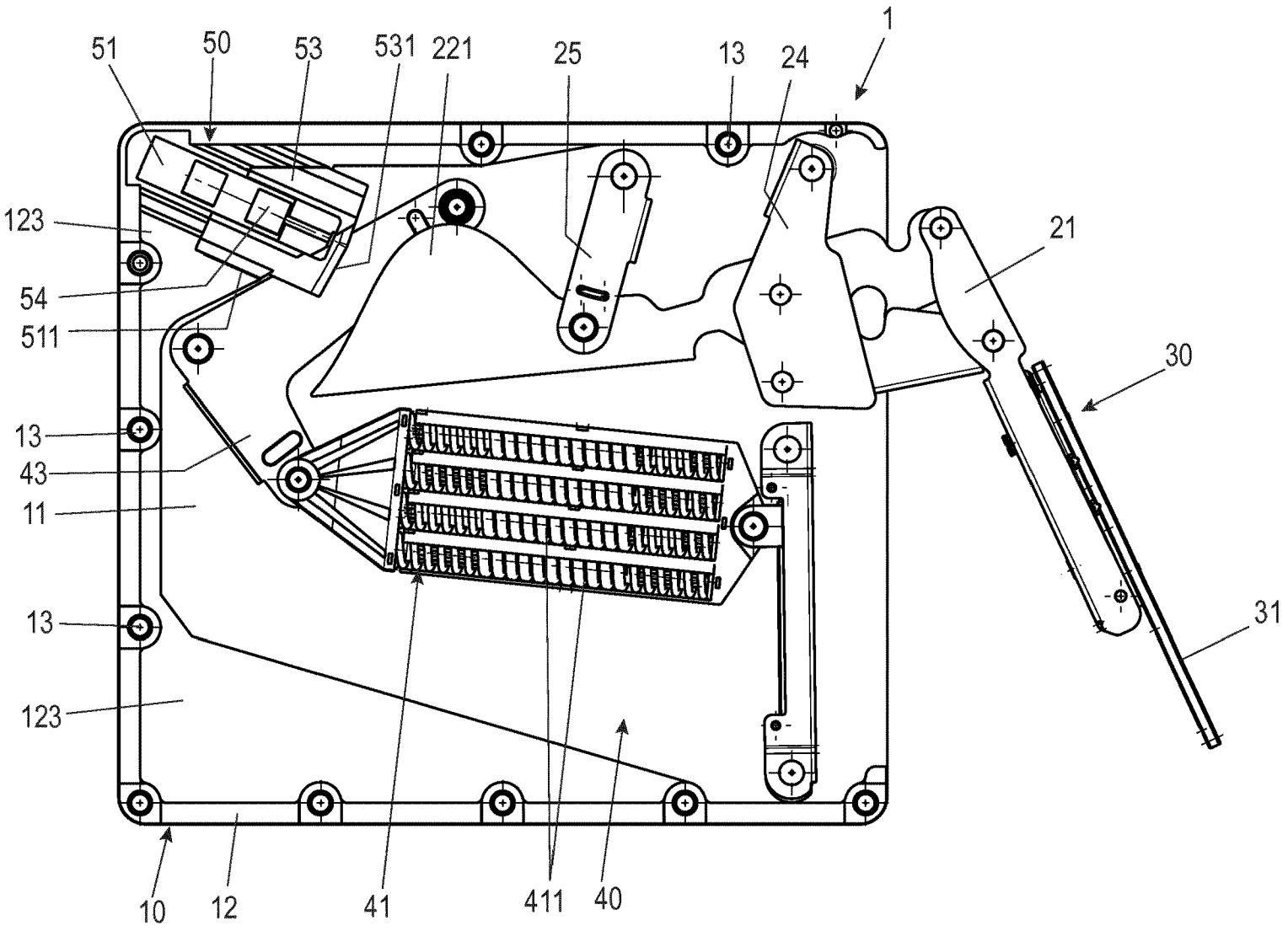

In FIGS. 5*a* and 5*b*, comparably to FIGS. 1*a* and 2*a*, the flap fitting 1 of the second exemplary embodiment having open housing 10 is illustrated in an isometric illustration in each case in a closed and an open end position, respectively. In FIGS. 6*a* and 6*b*, comparably to FIGS. 1*b* and 2*b*, the flap fitting 1 of the second exemplary embodiment is shown in the two end positions in a side view. FIGS. 6*c* and 6*d* show side views of the flap fitting in two intermediate positions of the door bearing lever 21 and/or an attached flap.

One difference from the first exemplary embodiment in the flap fitting 1 of the second exemplary embodiment is in the design of the spindle unit 42 of the spring unit 40. As in the first exemplary embodiment, the spring assembly 41 is fixed on one side so it is displaceable in its position on the housing 10 via the spindle unit 42 and acts at its other end on the intermediate lever 43. The spindle unit 42 differs in the second exemplary embodiment in that the spindle (not visible here) is arranged in a U-shaped guide rail. Pressure forces acting from the spring assembly 41 on the spindle unit 42 are absorbed in this design not only by the spindle, but rather also by the U-shaped rail.

A further difference is in the design of the frame 12, which comprises reinforcing ribs 123, in particular in the region of the rear section of the flap fitting 1 opposite to the opening. Moreover, the receptacle 51 of the damping unit 50 is integrated into the frame 12 and as a part of the reinforcing rib 123 in the top rear corner in this exemplary embodiment. The integral formation of the receptacle 51 in the frame 12 simplifies the installation, since the damping unit 50 does not have to be separately connected to the housing 10, specifically the side plates 11.

In the illustrated exemplary embodiment, the guide means 511 in the form of guide webs are also formed on the reinforcing rib 123. These webs interact with correspondingly shaped guide contours 532 and 533 of the slide 53. This slide in turn comprises the stop 531 in its front region, against which the transmission lever 22 strikes to damp a further closing movement. FIG. 6*b* shows an open and/or closed position of the door bearing lever shortly before the impact of the transmission lever 22 on the stop 531 and FIG. 6*c* shows a closed position, in which the impact has just occurred.

FIG. 7 shows the integration of the receptacle 51 into the frame 12 and the construction of the damping unit 50 in greater detail in in an isometric exploded illustration.

It can be seen in this figure that the linear damper 54 comprises a cylinder 541 and a piston having piston rod 542, wherein in this case—in contrast to the first exemplary embodiment—the linear damper 54 is positioned having the cylinder 541 in the receptacle 51, and the piston rod 542 interacts with the slide 53.

An opening damping can also be provided for the flap fitting 1. The damping unit for the opening damping is arranged at a different position than the damping unit 50 for the closing damping. A linear damper can also be used for the opening damping, wherein a rotation damper is also conceivable. The damping unit for the opening damping can be actuated, for example, by a lever arm of the intermediate lever 43.

A third exemplary embodiment of a flap fitting 1 is illustrated in FIGS. 8*a-c* and 9*a-e*. This third exemplary embodiment also corresponds in its basic structure and in particular the structure of its lever mechanism 20 to the first and thus also the second exemplary embodiment.

The spring unit 40 and in particular the displaceable guide of the spring assembly 41 are designed as in the second exemplary embodiment. Reference is hereby explicitly made to the description of the first and second exemplary embodiments.

Identical reference signs also identify identical or identically acting elements as in the previously shown figures in the third exemplary embodiment. In particular the differences of the third exemplary embodiment in relation to the second exemplary embodiment are explained in greater detail hereafter.

In FIGS. 8*a-c*, comparably to FIGS. 5*a* and 5*b*, the flap fitting 1 is shown having open housing 10 in three different isometric illustrations, specifically in a closed end position in FIG. 8*a* and in two partially open positions in FIGS. 8*b* and 8*c*.

In addition to the components of the second exemplary embodiment, in the present third exemplary embodiment, a further damping unit 60 is provided, which effectuates damping of the lever mechanism 20 and thus of an installed furniture part as it approaches the completely open end position. Like the damping unit 50, the further damping unit 60 is also integrated into the frame 12 in the region of a rear and lower reinforcing rib 123 in this case.

The further damping unit 60 comprises a receptacle 61, which is inserted into the reinforcing rib 123 or formed integrally therewith. The receptacle accommodates a linear damper 64, which is inserted here with a cylinder 641 into the receptacle 61. The receptacle 61 furthermore provides guide means 611, on which a slide 63 is displaceably mounted. The slide 63 interacts with a piston rod 642 of the linear damper 64. The further damping unit 60 therefore has a structure comparable to the damping unit 50 with regard to the linear damper 64 and the receptacle 61 thereof and its interaction with the slide 63.

Furthermore, a two-sided deflection lever 65, which has a first or second sliding part 651, 652 respectively on both sides, is provided as part of the further damping unit 60. Instead of the sliding parts 651, 652, the use of a pressure roller at these two points is also conceivable.

The first sliding part 651 presses against the slide 63. The second sliding part 652 ends in the movement region of the intermediate lever 43, which transmits spring forces of the spring assembly 41 to the lever mechanism 20.

As is apparent in the comparison of FIGS. 8*a* and 8*b*, the second pressure piece 652 is spaced apart from the intermediate lever 43 in the closed state of the flap fitting 1. With progressing opening movement of the lever mechanism 20 of the flap fitting 1, the intermediate lever 43 approaches the second sliding part 652. Between the positions of the lever mechanism 20 shown in FIG. 8*b* and in FIG. 8*c*, the intermediate lever 43 then contacts the second sliding part 652 with a corresponding contact surface 432. Any further opening movement of the lever mechanism 20 is then transmitted via the deflection lever 65 to the slide 63 and thus to the further linear damper 64. The further damping unit 60 accordingly damps the opening movement of the lever mechanism 20 as it approaches the completely open end position.

To now move the further damping unit 60 back into the starting position shown in FIG. 8*a* after renewed closing of the furniture part and/or the lever mechanism 20, a return spring is provided, which is integrated into the linear damper 64 in the illustrated example. To obtain a defined starting point for the use of the damping, a stop 66, which defines the starting position of the deflection lever 65 shown in FIG. 8*a*, is formed on the housing 10, specifically on the frame 12 in the region of the deflection lever 65.

By way of the combination of the damping unit 50 and the further damping unit 60, both a closing damping (by the damping unit 50) and also an opening damping (by the further damping unit 60) are achieved independently of one another. Due to the implementation of the closing and opening damping with the aid of different damping units 50, 60, damping parameters and the starting points of the damping can advantageously be selected independently of one another. It is obvious that in alternative designs, only an opening damping can also be implemented, in that a flap fitting comprises the further damping unit 60, but not the damping unit 50.

Figure 9A:
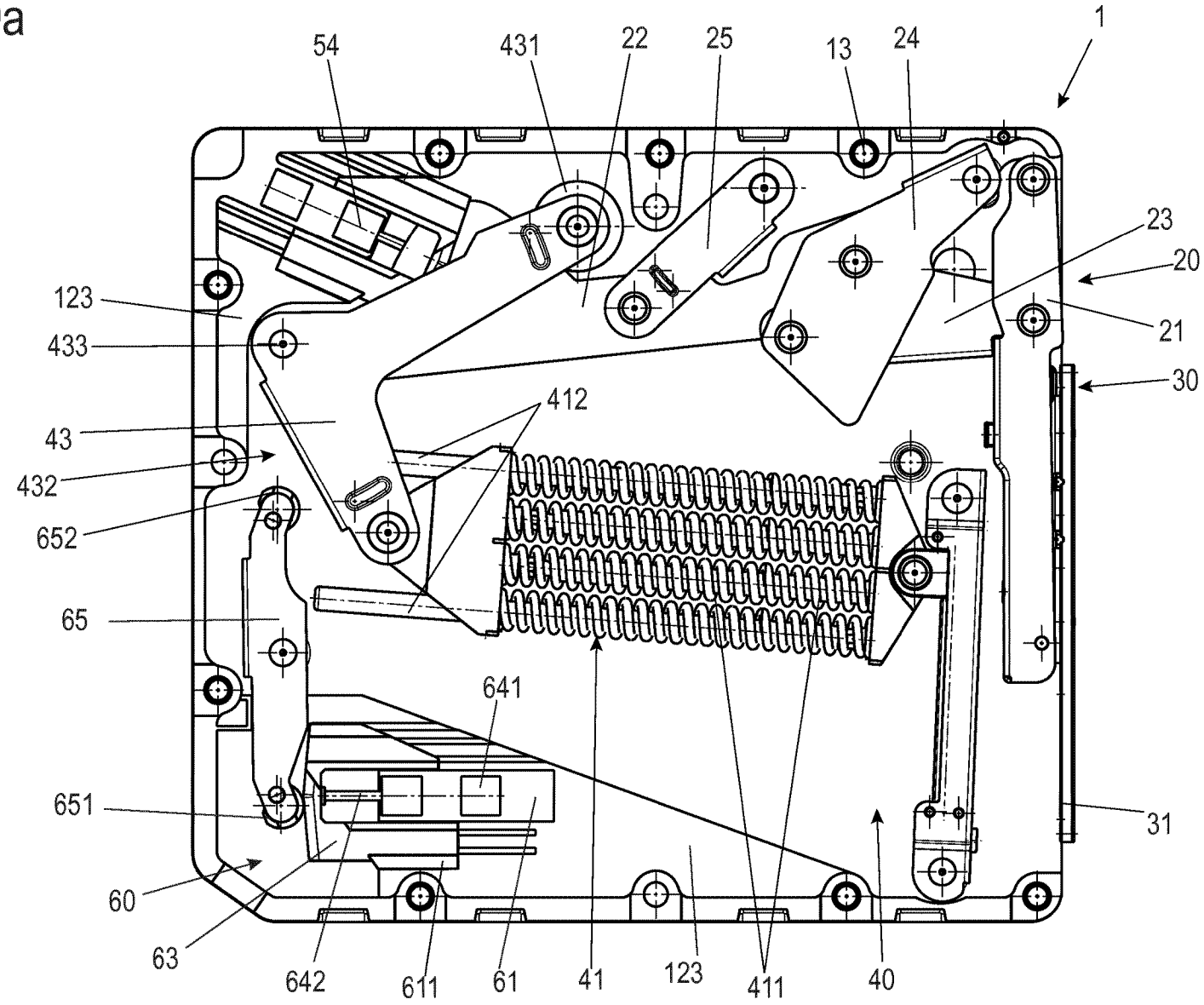
Figure 9B:
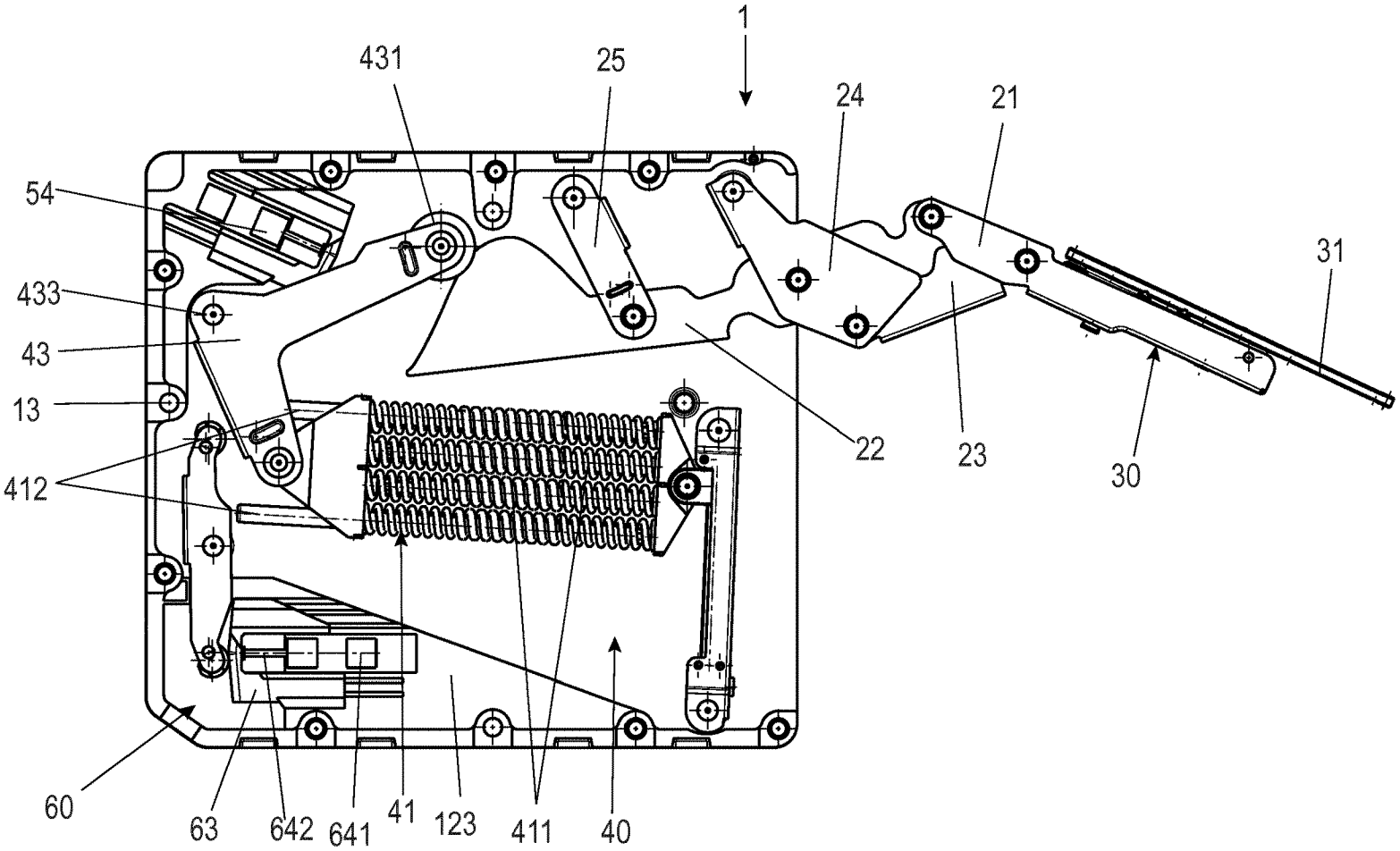
Figure 9C:
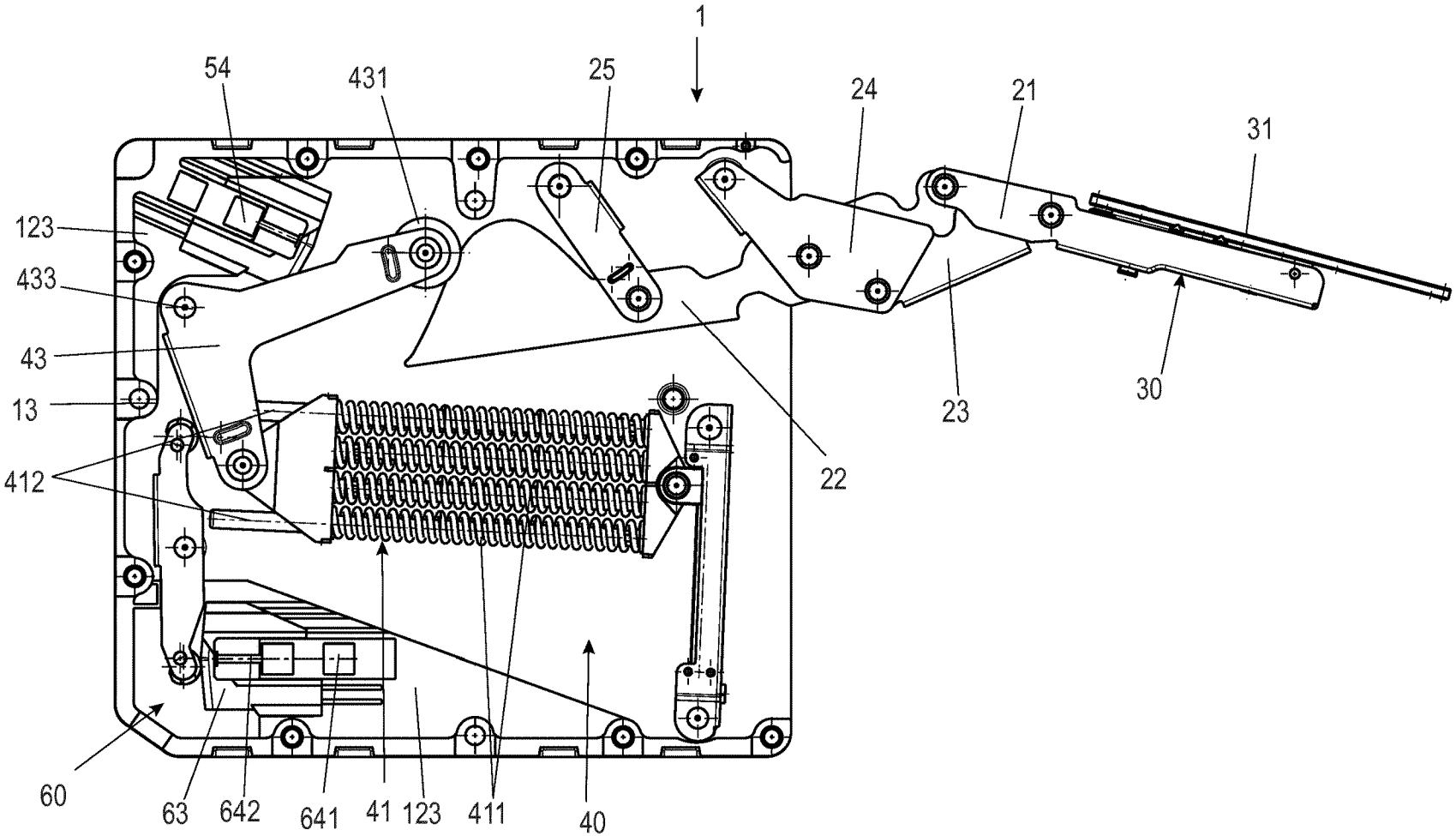
Figure 9D:
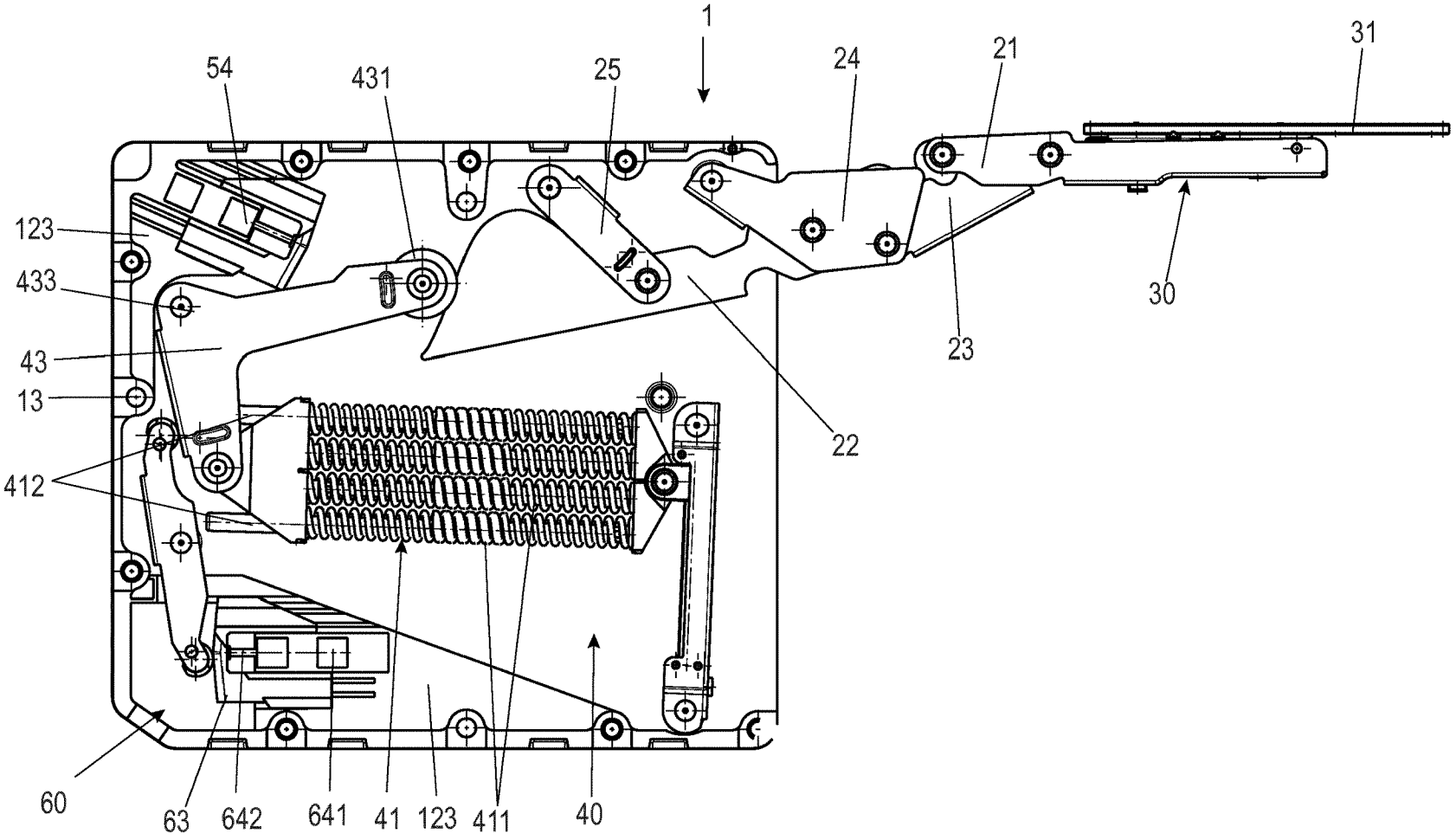
Figure 9E:
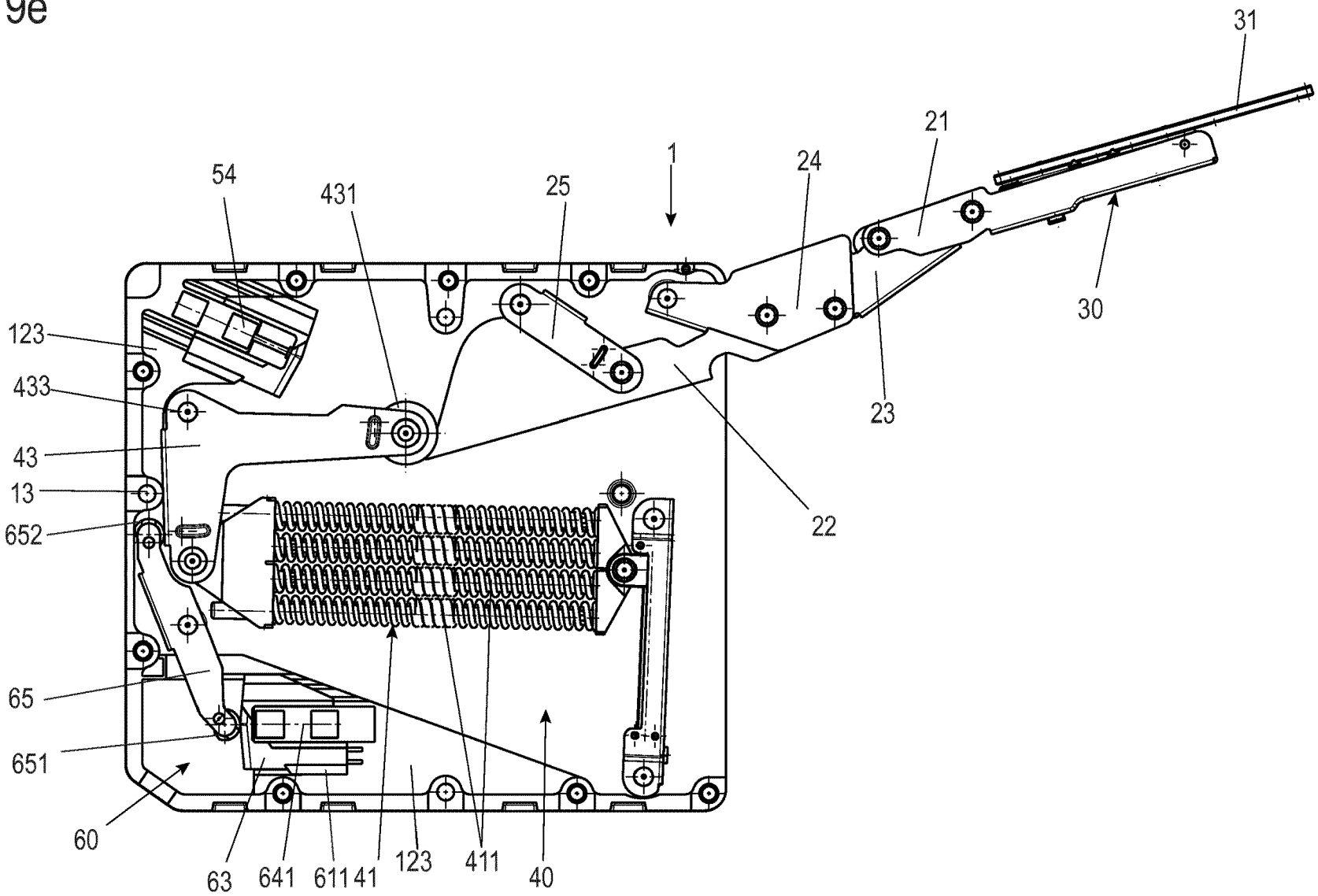

An opening movement is illustrated step-by-step once again in five different positions in FIGS. 9*a-e*. In this case, FIGS. 9*a* and 9*e* show the completely closed and completely open position, respectively, and FIGS. 9*b-d* each show intermediate positions having increasing opening angle of the lever mechanism 20 and/or a corresponding furniture part supported by the lever mechanism 20.

A further difference from the preceding exemplary embodiments relates to the spring assemblies 40. In this example, guide rods 412 are provided, which lead through the outer ones of the compression springs 411 and guide the movement during the compression or relaxation within the spring assembly 40. In the exemplary embodiments shown above, a comparable guide is achieved by guide channels in which the compression springs 411 are externally enclosed.

A further exemplary embodiment of a flap fitting 1 having integrated damping is shown in FIGS. 10*a-d*. The figures are each side views of the flap fitting 1 having open housing cover in various open positions of the flap fitting 1.

Figure 10A:
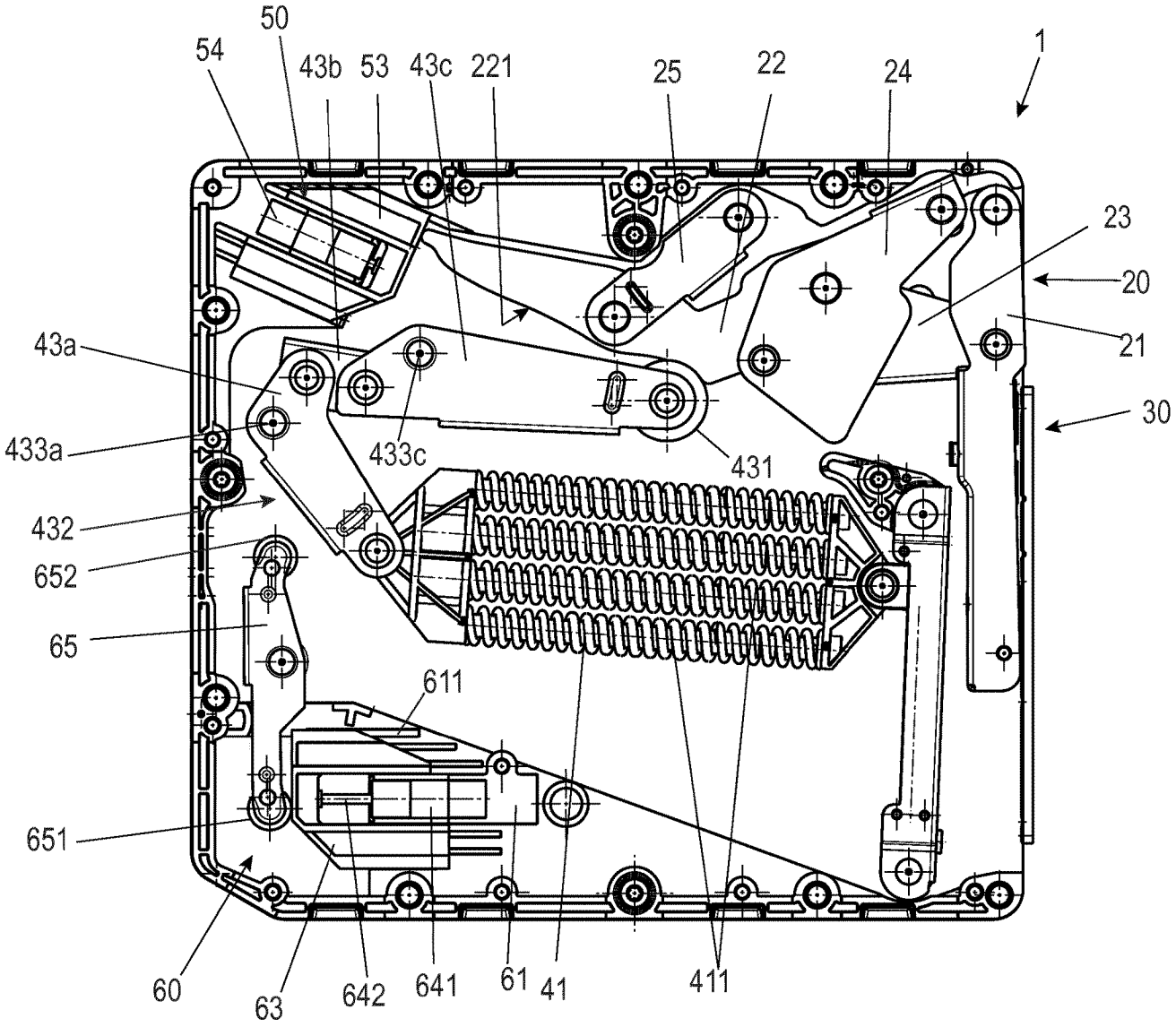
Figure 10B:
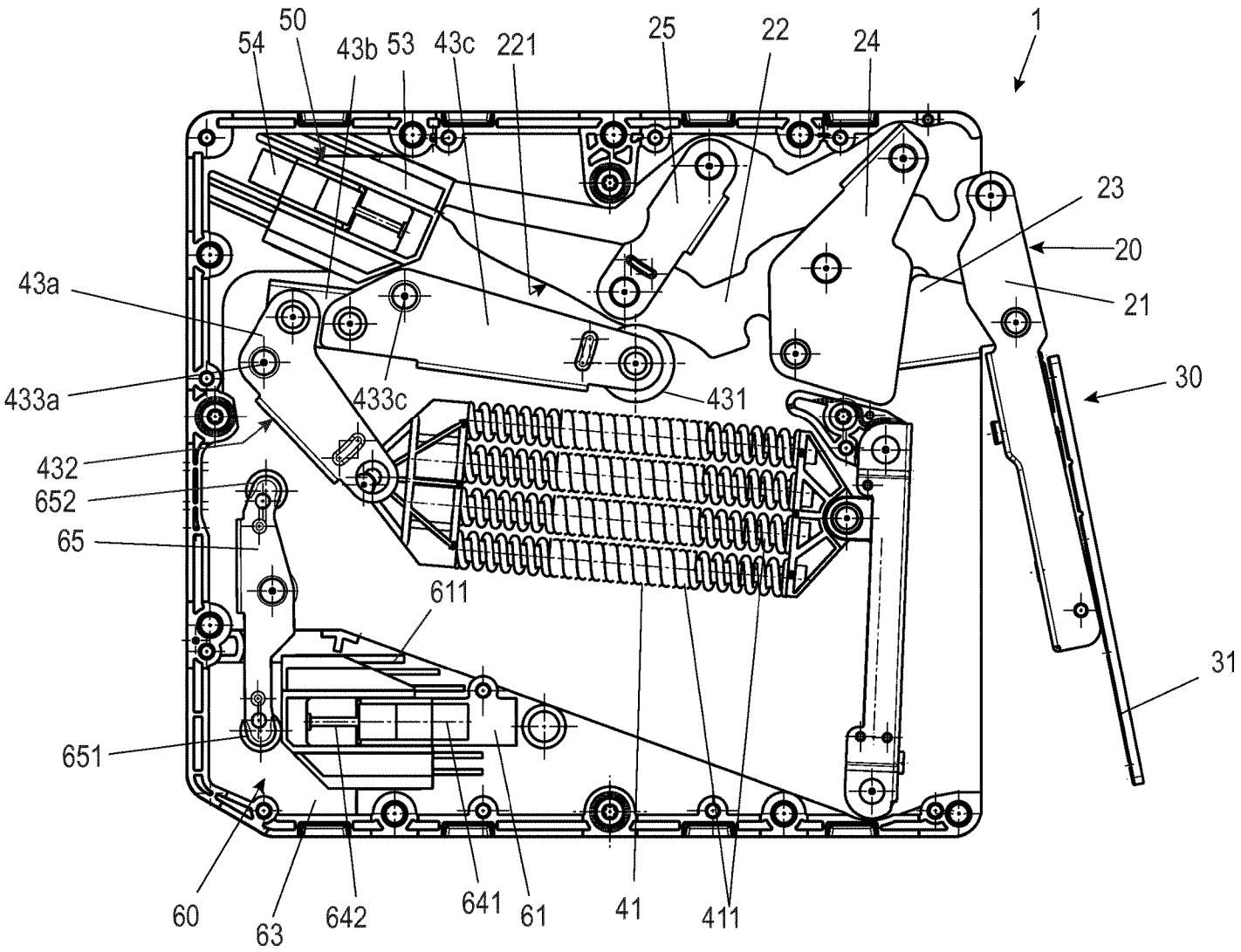
Figure 10C:
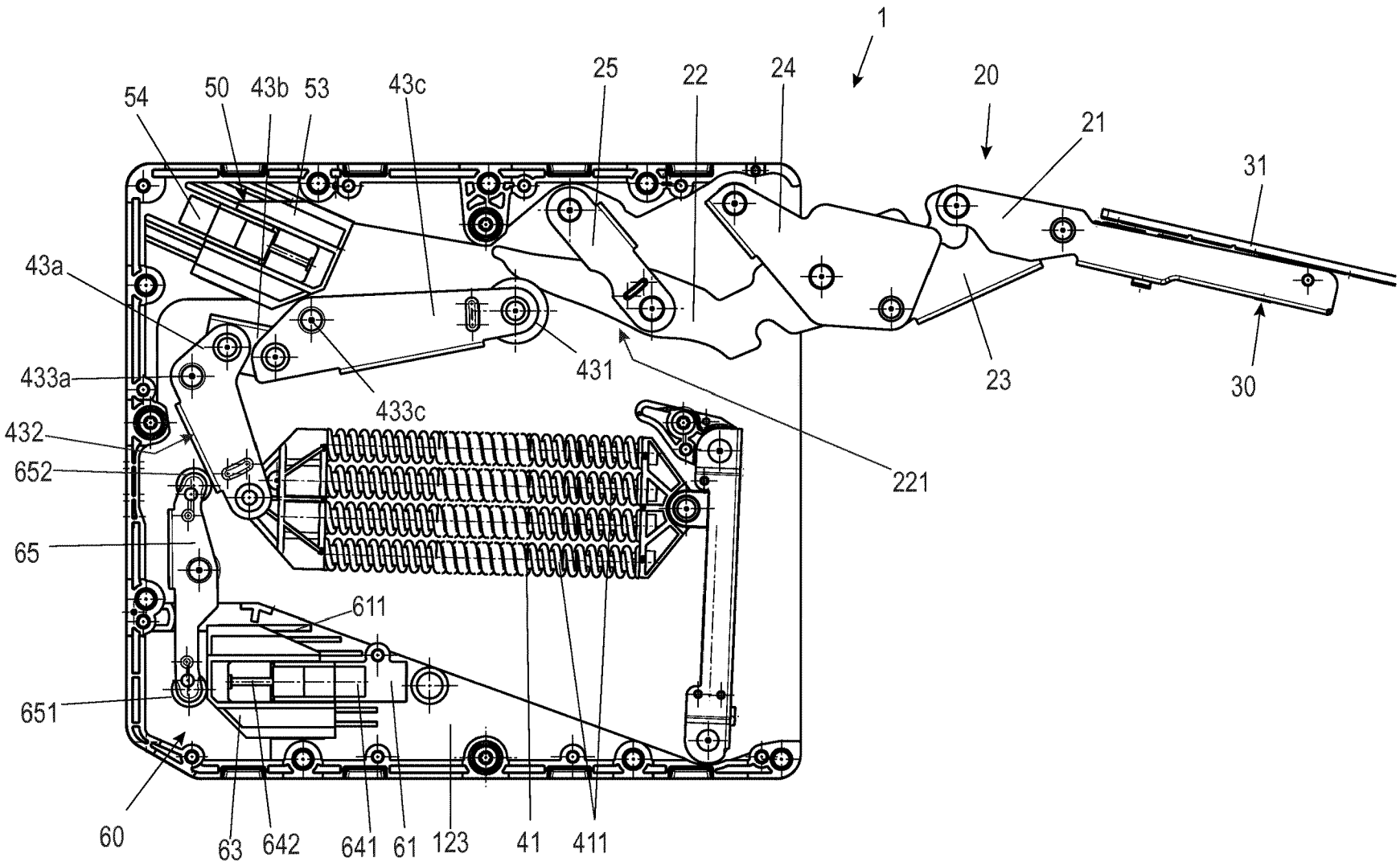
Figure 10D:
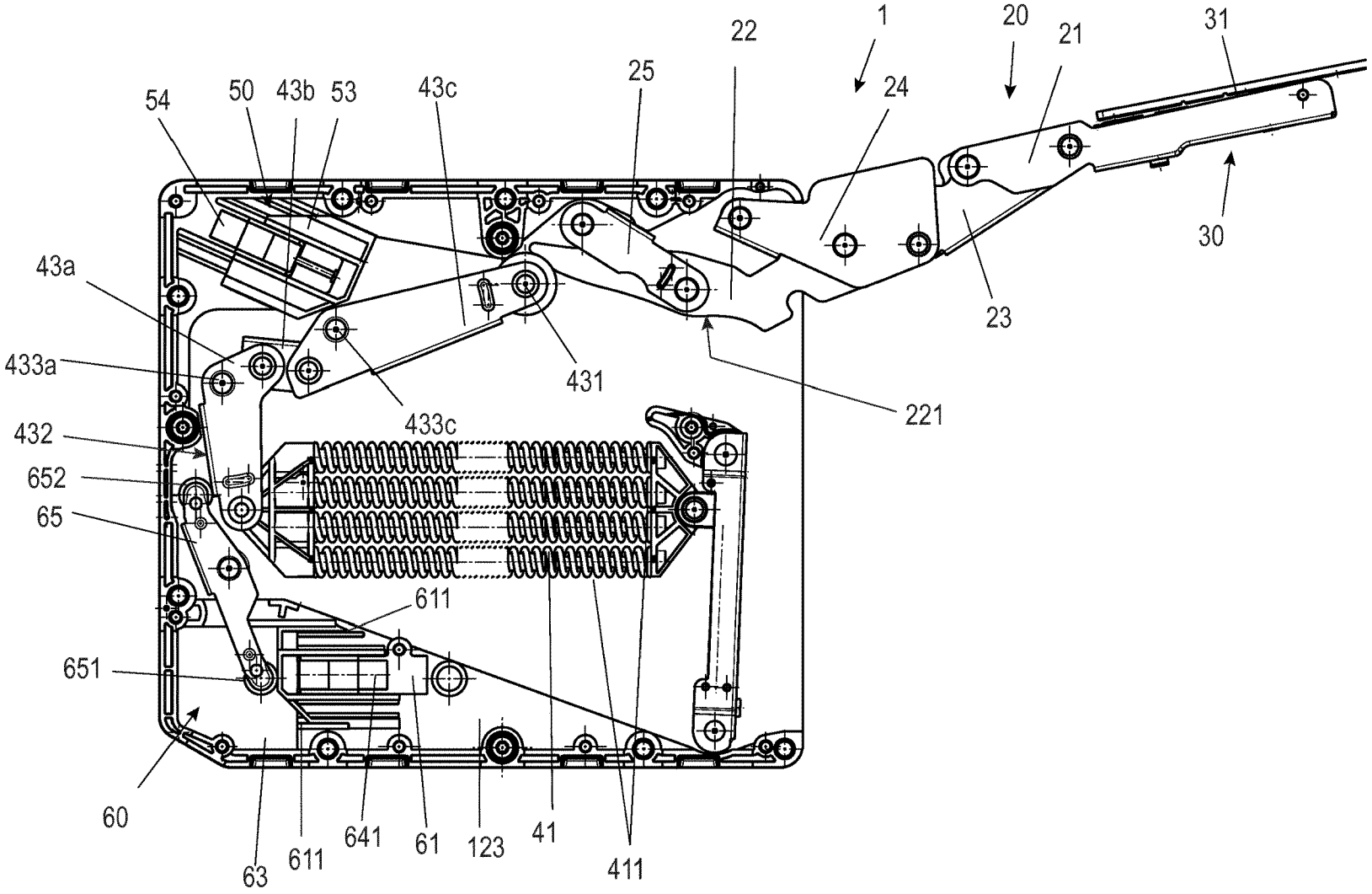

FIG. 10*a* shows the fitting in the closed position having completely retracted lever mechanism 20, FIGS. 10*b* and 10*c* show two intermediate positions, and FIG. 10*d* shows the flap fitting 1 having completely extended lever mechanism 20.

In this exemplary embodiment, both a closing damping and also an opening damping are also implemented. The corresponding damping units 50, and also the further damping unit 60, correspond in the structure thereof to those from the preceding exemplary embodiment of FIGS. 8*a-c* and 9*a-e*.

The force transmission between the transmission lever 22 and the spring unit 40 is different in the exemplary embodiment of FIGS. 10*a-e*. Instead of the single two-sided intermediate lever 43, which was used in all preceding exemplary embodiments, in the present case a transmission via a lever arrangement consisting of three individual levers 43*a-e* is provided.

The lever arrangement comprises two two-sided levers 43*a* and 43*c*, which are coupled to one another via a connecting lever 43*b*. The housing-fixed pivot points of the levers 43*a* and *c* are indicated by the reference signs 433*a* and 433*c* in FIGS. 10*a*-10*e*. One end of the lever arrangement, an end of the first lever 43*a* here, is again connected to the spring assembly 41 and a free end of the lever arrangement, an end of the third lever 43*c* here, bears a pressure roller 431, which acts on a correspondingly formed control section 221 of the transmission lever 22.

In comparison to the single lever 43 of the preceding exemplary embodiments, the lever arrangement of the levers 43*a-c* results in a movement direction reversal. The control section 221 is accordingly formed on the lower side of the transmission lever 22 in FIGS. 10*a-e*, and not on the upper side in the figures. The roller 431 is pressed upward, not downward, by the force of the compression springs 411 of the spring assembly 41, on the one hand, to hold the lever mechanism 20 in the closed position and, on the other hand, to assist the opening movement at larger opening angles.

The arrangement shown can be advantageous in relation to the arrangement shown in the first exemplary embodiments if a more compact structure of the flap fitting 1 is in the foreground.

The closing damping is achieved in all exemplary embodiments shown by a direct contact of the free end of the transmission lever 22 with the slide 53 of the damping unit 50. The opening damping is achieved by a contact of the contact surface 432 of the first lever 43*a* of the lever arrangement with the second pressure piece 652 of the deflection lever 65.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 flap fitting
2 side wall
3 end face
4 opening

5 side surface
10 housing
11 side plate
12 frame
121 widened section
122 recess
123 reinforcing rib
13 rivet
20 lever mechanism
21 door bearing lever
22 transmission lever
221 control section
23 deflection lever
24 control lever
25 support lever
30 adjustment unit
31 installation plate
40 spring unit
41 spring assembly
411 compression spring
412 guide rod
42 spindle unit
43 intermediate lever
431 compression roller
432 contact surface
433 pivot point
50 damping unit
51 receptacle
511 guide means
52 fastening
53 slide
531 stop
532, 533 guide contour
54 linear damper
541 cylinder
542 piston rod
60 further damping unit
61 receptacle
611 guide means
63 slide
64 linear damper
641 cylinder
642 piston rod
65 deflection lever
651 first sliding part
652 second sliding part
66 stop

The invention claimed is:

1. A flap fitting for an item of furniture, the flap fitting comprising:
a lever mechanism having multiple levers configured to guide a flap of the item of furniture; and
a damping unit having at least one damper for damping the flap as the flap approaches a closed end position,
wherein the damping unit is arranged inside a housing of the flap fitting,
wherein the damping unit comprises a stop, against which one of the multiple levers of the lever mechanism rests to damp movement of the flap,
wherein the flap fitting comprises a spring unit, which acts via a pressure roller on a control section of the lever mechanism and holds the flap fitting in the closed and/or an open end position,
wherein the stop of the damping unit is actuated by the control section of the lever mechanism during closing of the flap fitting, and
wherein the damping unit comprises a receptacle for the at least one damper, wherein the receptacle comprises a guide to guide a slide, on which the stop is formed.

2. The flap fitting of claim 1, wherein the lever mechanism forms a seven-joint mechanism, wherein the multiple levers include a transmission lever and further levers, and wherein the transmission lever is connected at three points of articulation to the further levers.

3. The flap fitting of claim 2, wherein the transmission lever presses against the stop in the closed end position.

4. The flap fitting of claim 2, wherein the transmission lever rests with the control section on the stop in the closed end position.

5. The flap fitting of claim 1, wherein the damper is a linear damper having a cylinder and a piston having piston rod, wherein
the cylinder is coupled to the receptacle and the piston rod is coupled to the slide, or
the cylinder is coupled to the slide and the piston rod is coupled to the receptacle.

6. The flap fitting of claim 1, wherein the housing of the flap fitting comprises two parallel side plates spaced apart from one another by an interposed frame.

7. The flap fitting of claim 6, wherein the damping unit is installed on at least one of the two parallel side plates.

8. The flap fitting of claim 6, wherein the damping unit is installed on the frame.

9. The flap fitting of claim 6, wherein the damping unit is integrated into the frame.

10. The flap fitting of claim 6, wherein the two parallel side plates of the housing have an inner spacing less than 16 mm.

11. The flap fitting of claim 1, wherein the housing of the flap fitting comprises two parallel side plates spaced apart from one another by an interposed frame, and wherein the receptacle of the damping unit is integrated into the frame.

12. A side wall for a furniture body, the side wall, comprising:
a flap fitting for an item of furniture that is inserted or integrated in the side wall, the flap fitting comprising
a lever mechanism having multiple levers configured to guide a flap of the item of furniture; and
a damping unit having at least one damper for damping the flap as the flap approaches a closed end position,
wherein the damping unit is arranged inside a housing of the flap fitting,
wherein the damping unit comprises a stop, against which one of the multiple levers of the lever mechanism rests to damp movement of the flap,
wherein the flap fitting comprises a spring unit, which acts via a pressure roller on a control section of the lever mechanism and holds the flap fitting in the closed and/or an open end position,
wherein the stop of the damping unit is actuated by the control section of the lever mechanism during closing of the flap fitting, and
wherein the damping unit comprises a receptacle for the at least one damper, wherein the receptacle comprises a guide to guide a slide, on which the stop is formed.

13. An item of furniture, comprising:
a furniture body;
a guided flap;
wherein the furniture body includes at least one side wall, which comprises a flap fitting for an item of furniture that is inserted or integrated in the side wall, the flap fitting comprising a lever mechanism having multiple levers configured to guide a flap of the item of furniture; and a damping unit having at least one damper for damping the flap as the flap approaches a closed end position, wherein the damping unit is arranged inside a housing of the flap fitting, wherein the damping unit comprises a stop, against which one of the multiple levers of the lever mechanism rests to damp movement of the flap, wherein the flap fitting comprises a spring unit, which acts via a pressure roller on a control section of the lever mechanism and holds the flap fitting in the closed and/or an open end position, wherein the stop of the damping unit is actuated by the control section of the lever mechanism during closing of the flap fitting, and wherein the damping unit comprises a receptacle for the at least one damper, wherein the receptacle comprises a guide to guide a slide, on which the stop is formed.

* * * * *